US008348564B2

(12) United States Patent
Fukui

(10) Patent No.: US 8,348,564 B2
(45) Date of Patent: Jan. 8, 2013

(54) CONTAINER COUPLING DEVICE

(75) Inventor: Fumimochi Fukui, Kobe (JP)

(73) Assignee: Sanwa Co., Ltd., Hyogo (JP)

( * ) Notice: Subject to any disclaimer, the term of this patent is extended or adjusted under 35 U.S.C. 154(b) by 331 days.

(21) Appl. No.: 12/934,722

(22) PCT Filed: Jan. 30, 2009

(86) PCT No.: PCT/JP2009/051596

§ 371 (c)(1),
(2), (4) Date: Sep. 27, 2010

(87) PCT Pub. No.: WO2009/128284

PCT Pub. Date: Oct. 22, 2009

(65) Prior Publication Data

US 2011/0036742 A1 Feb. 17, 2011

(30) Foreign Application Priority Data

Apr. 16, 2008 (JP) ..... 2008-106885

(51) Int. Cl.
*B60P 7/08* (2006.01)

(52) U.S. Cl. ..... 410/69

(58) Field of Classification Search ..... 410/69, 410/71, 76, 82, 83, 84; 280/406.1; 24/287; 248/500, 503

See application file for complete search history.

(56) References Cited

U.S. PATENT DOCUMENTS 5,183,375 A 2/1993 Fenton et al.
5,758,391 A 6/1998 Donner et al.
5,765,977 A 6/1998 Reynard
7,484,918 B2 * 2/2009 Brewster ..... 410/69

(Continued)

FOREIGN PATENT DOCUMENTS

CN 1155871 7/1997

(Continued)

OTHER PUBLICATIONS

International Search Report issued Mar. 10, 2009 in International (PCT) Application No. PCT/JP2009/051596.

(Continued)

*Primary Examiner* — Stephen Gordon
(74) *Attorney, Agent, or Firm* — Wenderoth, Lind & Ponack, L.L.P.

(57) ABSTRACT

According to a container coupling device 1 of an embodiment, when a container has been lifted with an upper fitting (4) and a lower fitting (5) being engaged with corner fittings (F) of an upper container and a lower container, respectively, via a spring mechanism, a container weight acts on a lower half portion (42) of the upper fitting (4) that crosses an engaging hole (Fa) of the corner fitting (F) of the upper container and on an upper half portion (51) of the lower fitting (5) that crosses an engaging hole (Fa) of the corner fitting (F) of the lower container. The upper fitting (4) and the lower fitting (5) are forcibly rotated against a biasing force of the spring mechanism in a direction in which the upper fitting and the lower fitting overlap an upper fitted portion (22) and a lower fitted portion (23), respectively. As a result, the lower fitting (5) rotates to a position at which the lower fitting overlaps the lower fitted portion (23) while the upper fitting (4) is engaged with the bottom corner fitting (F) of the upper container, and is thus released from the corner fitting (F).

10 Claims, 18 Drawing Sheets

U.S. PATENT DOCUMENTS

2009/0116901 A1 5/2009 Bohman et al.

FOREIGN PATENT DOCUMENTS

| | | |
|---|---|---|
| GB | 2 290 825 | 1/1996 |
| JP | 55-158833 | 11/1980 |
| JP | 01-124590 | 5/1989 |
| JP | 10-507984 | 8/1998 |
| JP | 2006-076636 | 3/2006 |
| JP | 2007-1661 | 1/2007 |
| JP | 2008-174294 | 7/2008 |
| WO | 92/05093 | 4/1992 |

OTHER PUBLICATIONS

Comments on Written Opinion of International Searching Authority filed Aug. 7, 2009 in International (PCT) Application No. PCT/JP2009/051596.

Chinese Office Action issued Oct. 26, 2011 in corresponding Chinese Patent Application No. 200980113444.3 with English translation.

* cited by examiner (a)

(b)

(c)

(d)

(e)

CONTAINER COUPLING DEVICE

TECHNICAL FIELD

The present invention relates to a container coupling device that can be disposed between vertically adjacent containers stacked in multiple levels in a container yard or on an container ship and used to couple the two containers together.

BACKGROUND ART

As shown in FIG. 15, loading and unloading of containers Ct between container yards Yd and container ships Sh have conventionally been performed.

For example, in the case where a container Ct in a container yard Yd is loaded onto a container ship Sh, the container Ct is transferred from the container yard Yd onto a container conveying vehicle V such as a trailer by means of a transfer crane Tc or the like and then transported to an apron Ap. On the apron Ap, the container Ct is lifted by a spreader Sp of a container crane Cr and placed on top of another container Ct on a deck of the container ship Sb.

On the other hand, in the case of unloading a container Ct from the deck of the container ship Sh, the container Ct is lifted by the container crane Cr via the spreader Sp and moved to the apron Ap. Thereafter, the container Ct is transferred from the container crane Cr to the container conveying vehicle V and then transported from the apron Ap to the container yard Yd.

When containers Ct are stacked in multiple levels in the container yard Yd, on the container ship Sh, or in other places, in order to prevent the containers Ct from coming unfastened and shifted, for example, Patent Document 1 discloses a method in which a container coupling device is disposed between corner fittings provided on the bottom four corners of an upper container Ct and corner fittings provided on the top four corners of a lower container Ct to couple the containers Ct to each other.

A container coupling device of this type will be described with reference to FIGS. 16 to 20.

A container coupling device 100 includes a device main body 101 that is dividable into parts, which are fastened together into a single unit with a bolt. As shown in FIG. 19, the container coupling device 100 includes a shaft 102 that is axially supported in the device main body 101 in a rotatable manner. An upper cone 103 and a lower cone 104 shown in FIG. 16 are integrally connected to an upper end and a lower end of the shaft 102.

The device main body 101 includes an upper fitted portion 101U and a lower fitted portion 101D integrally formed, respectively, in an upper part and a lower part thereof and each having a shape that matches an engaging hole Fa (see FIG. 20(*b*)) of a corner fitting F of a container Ct. The upper fitted portion 101U and the lower fitted portion 101D can be fitted into the engaging hole Fa of a bottom corner fitting F of an upper container Ct and the engaging hole Fa of a top corner fitting F of a lower container Ct, respectively. The device main body 101 has a through hole (not shown) extending through the upper fitted portion 101U and the lower fitted portion 101D, and this through hole supports the shaft 102 in a rotatable manner.

It should be noted that the corner fittings F of the containers Ct are not shown in detail in the drawings, but are specified in JIS Z 1616 together with the engaging hole Fa.

The upper cone 103 and the lower cone 104 are engageable with the corner fittings F of the containers Ct through the engaging holes Fa and are individually formed in a shape corresponding to the engaging hole Fa of the corner fitting F as viewed from above. As the shaft 102 rotates, the upper cone 103 and the lower cone 104 rotate on a top surface of the upper fitted portion 101U and a bottom surface of the lower fitted portion 101D, respectively, of the device main body 101.

The upper cone 103 and the lower cone 104 are integrally connected to the shaft 102 so as to cross in an X shape as viewed from above so that when the upper cone 103 is inserted into or released from the engaging hole Fa of the bottom corner fitting F of the upper container Ct, the lower cone 104 is engaged with the top corner fitting F of the lower container Ct, and when the lower cone 104 is inserted into or released from the engaging hole Fa of the top corner fitting F of the lower container Ct, the upper cone 103 is engaged with the bottom corner fitting F of the upper container Ct.

Here, the lower cone 104 is formed in such a shape that when the lower cone 104 is in a position at which the lower cone 104 crosses the engaging hole Fa of the corner fitting F, a rotational force is applied to the lower cone 104 when the lower cone 104 is forced against the engaging hole Fa of the corner fitting F. That is to say, the lower cone 104 is formed in such a manner that in a state in which the lower cone 104 crosses the engaging hole Fa of the corner fitting F with the shaft 102 in a first rotation position A (described later), when the lower cone 104 is forced against an outer circumferential edge of the engaging hole Fa of the corner fitting F, a pressing force is exerted on the corner fitting F via the lower cone 104, while the lower cone 104 receives a reaction force, and the reaction force acting on the lower cone 104 causes the lower cone 104 to rotate around a rotation axis of the shaft 102.

As shown in FIG. 19, a cavity 101X having a first locking portion 101*a* and a second locking portion 101*b* is formed inside the device main body 101. An arm 1021 integrally fixed to the shaft 102 can abut against the first locking portion 101*a* and the second locking portion 101*b*. The shaft 102 can rotate between the first rotation position A at which the arm 1021 abuts against the first locking portion 101*a* of the cavity 101X and a third rotation position C at which the arm 1021 abuts against the second locking portion 101*b*.

A torsion spring 105 is disposed on the shaft 102. The torsion spring 105 biases the shaft 102 so that the arm 1021 abuts against the first locking portion 101*a* of the cavity 101X. A groove 1022 is formed in a circumference of the shaft 102. A wire 106 is wound on the shaft 102 along this groove 1022. A loop portion at one end of the wire 106 is inserted through the arm 1021. The other end of the wire 106 is led outside through a mouthpiece 107 slidably disposed on the device main body 101, and is anchored to an operation knob 108.

A locking member 1061 is formed in the vicinity of the other end of the wire 106. Right and left ends of this locking member 1061 can be selectively locked in slots 107*a* and 107*c* formed in an upper part and a lower part of the mouthpiece 107 that is slidably fitted in a guide 101Y of the device main body 101.

The mouthpiece 107 is disposed with its right and left ends both being fitted in the guide 101Y of the device main body 101, so as to be slidable along the guide 101Y. Moreover, the mouthpiece 107 is biased by a spring 109 disposed on the device main body 101 so as to abut against an end of the guide 101Y.

As shown in FIG. 15, in coupling together vertically adjacent containers Ct on the container ship Sh, first, a container Ct is transferred from the container yard Yd onto the container conveying vehicle V by using the transfer crane Tc or the like and transported to the apron Ap. Then, on the apron Ap, the container Ct is lifted to and stopped at a level of about one meter above the ground by the spreader Sp of the container crane Cr. Here, as shown in FIG. 20(*a*), the upper cone 103 of the container coupling device 100 is attached to the bottom corner fitting F of the container Ct.

Specifically, an operator grasps and pulls the operation knob 108 to lock the locking member 1061 of the wire 106 in the slot 107*a* of the mouthpiece 107. In this state, the shaft 102 is in the third rotation position C at which the arm 1021 abuts against the second locking portion 101*b* of the cavity 101X of the device main body 101. Moreover, the upper cone 103 is in a position at which the upper cone 103 overlaps the upper fitted portion 101U of the device main body 101 as viewed from above. Thus, the operator can insert the upper cone 103, together with the upper fitted portion 101U of the device main body 101, into the engaging hole Fa of the bottom corner fitting F of the upper container Ct.

Once the operator has inserted the upper cone 103 into the corner fitting F through the engaging hole Fa, the operator again grasps and pulls the operation knob 108 to release the locking member 1061 of the wire 106 from the slot 107*a* of the mouthpiece 107. As a result, the shaft 102, due to a biasing force of the torsion spring 105, returns to the first rotation position A at which the arm 1021 abuts against the first locking portion 101*a* of the cavity 101X of the device main body 101. In this state, as described above, the upper cone 103 and the lower cone 104 of the container coupling device 100 are positioned such that the cones individually cross the engaging hole Fa of the corner fitting F. Thus, the upper cone 103 is engaged with the corner fitting F, and the container coupling device 100 is retained by the bottom corner fitting F of the container Ct without falling out.

As shown in FIG. 20(*b*), when the container coupling device 100 has been attached to the bottom corner fitting F of the container Ct, next, the container Ct can be lifted by the container crane Cr and placed on top of another container Ct on a deck of the container ship Sh. At this time, the lower cone 104 of the container coupling device 100 is forcibly rotated against the biasing force of the torsion spring 105 along the outer circumferential edge of the engaging hole Fa of the top corner fitting F of the other container Ct. Then, when the lower cone 104 overlaps the lower fitted portion 101D of the device main body 101 as viewed from above, the lower cone 104, together with the lower fitted portion 101D of the device main body 101, is fitted into the engaging hole Fa of the top corner fitting F of the other container Ct. Once the lower cone 104 has been fitted into the top corner fitting F, the lower cone 104, due to the biasing force of the torsion spring 105, returns again to the position at which the lower cone 104 crosses the engaging hole Fa of the corner fitting F, and thus engages with the corner fitting F. Consequently, as shown in FIG. 20(*c*), the upper and lower containers Ct are coupled together by the upper cone 103 of the container coupling device 100 engaged with the bottom corner fitting F of the upper container Ct and the lower cone 104 of the container coupling device 100 engaged with the top corner fitting F of the lower container Ct.

On the other hand, as shown in FIG. 20(*d*), in the case of unloading containers Ct from the deck of the container ship Sh, the operator pulls or pushes the operation knob 108 downward from on the deck to lock the locking member 1061 of the wire 106 in the slot 107*c* of the mouthpiece 107. In this state, the shaft 102 is in a second rotation position B at which its arm 1021 is located between the first locking portion 101*a* and the second locking portion 101*b* of the cavity 101X of the device main body 101. The lower cone 104 is overlapping the lower fitted portion 101D of the device main body 101 as viewed from above. As a result, the lower cone 104 of the container coupling device 100 can be released through the engaging hole Fa of the top corner fitting F of the lower container Ct.

Then, after the container Ct is lifted and moved via the spreader Sp of the container crane Cr and stopped at a level of about one meter above the ground of the apron. Ap, the upper cone 103 of the container coupling device 100 is released from the bottom corner fitting F of the container Ct. The operator grasps and pulls the operation knob 108 to lock the locking member 1061 of the wire 106 in the slot 107*a* of the mouthpiece 107. In this state, as described above, the shaft 102 is in the third rotation position C at which its arm 1021 abuts against the second locking portion 101*b* of the cavity 101X of the device main body 101. Moreover, the upper cone 103 is overlapping the upper fitted portion 101U of the device main body 101 as viewed from above. Thus, as shown in FIG. 20(*e*), the upper cone 103 of the container coupling device 100 can be released from the engaging hole Fa of the bottom corner fitting F of the container Ct. Afterward, the container Ct is transferred from the container crane Cr onto the container conveying vehicle V and transported from the apron Ap to the container yard Yd.

As described above, with the container coupling device 100, during loading of containers Ct, the container coupling device 100 is attached to a bottom corner fitting F of a container Ct to be loaded, and the container Ct is then placed on top of another container Ct. When the lower cone 104 has been rotated along the outer circumferential edge of the engaging hole Fa of a top corner fitting F of the lower container Ct and fitted into the corner fitting F, the lower cone 104 is automatically returned to the position at which the lower cone 104 engages with the corner fitting F by the torsion spring 105. As a result, the upper and lower containers Ct can be coupled together.

Moreover, during unloading of containers Ct, it is necessary to operate the operation knob 108 to rotate the lower cone 104 against the biasing force of the torsion spring 105 from the position at which the lower cone 104 engages with the corner fitting F to the position at which the lower cone 104 can be inserted or released. That is to say, as shown in FIG. 20(*d*), the operator is required to pull or push the operation knob 108 downward from on top of the uppermost container Ct of containers Ct stacked in multiple levels or from the deck (in the case of the container ship Sh) or the ground (in the case of the container yard Yd) by using a long tool to lock the locking member 1061 of the wire 106 in the slot 107*c* of the mouthpiece 107.

In this case, it is difficult for the operator to reliably operate the operation knob 108 with the tip of the long tool, and therefore, there are problems in that much time is needed for the work and that operating the heavy, long tool causes intense fatigue. Moreover, when the operator performs the operation from on top of the uppermost container Ct, the operator works at a high place, which entails danger such as accidentally falling down, and so there also is a drawback in terms of safety.

In view of these problems, for example, Patent Documents 2 and 3 propose a container coupling device referred to as a fully automatic container coupling device. With the fully automatic container coupling device, even during unloading of containers Ct, a container Ct to be unloaded is lifted via the container crane Cr. Thus, the lower cone is rotated against the biasing force of the torsion spring along the edge of the engaging hole Fa of the top corner fitting F of a lower container Ct to reach the position at which the lower cone overlaps the lower fitted portion of the device main body, whereas the upper cone is engaged with the bottom corner fitting F of the upper container Ct, and in this state, the lower cone is released from the engaging hole Fa of the top corner fitting F of the lower container Ct.

Patent Document 1: WO 92/05093A1
Patent Document 2: JP 2006-76636A
Patent Document 3: JP 2007-1661A

SUMMARY OF INVENTION

Technical Problem

In the above-described fully automatic container coupling device, the center of the rotation axis of the shaft and the center of the lower cone are offset in a width direction, so that during loading and unloading of containers, it is necessary to rotate the lower cone by moving the lower cone in one lateral direction. Therefore, it is not possible to move a pair of laterally opposite container devices attached to either the front or the rear corner fittings of a container in one lateral direction and move another pair of laterally opposite container coupling devices attached to the rear or the front corner fittings in one lateral direction at the same time. In this case, there is a necessity to engage or release the pair of laterally opposite container devices on either the front or the rear side and thereafter engage or release the other pair of laterally opposite container devices on the rear or the front side.

For example, the operator moves lower cones of a pair of laterally opposite container devices on the front side to the left to engage the lower cones with corresponding top corner fittings of a lower container. After that, the operator has to again move lower cones of another pair of laterally opposite container devices on the rear side to the right to engage the lower cones with corresponding top corner fittings of the lower container. Similarly, the operator has to move the lower cones of the pair of laterally opposite container devices on the front side to the right to release the lower cones from the corresponding top corner fittings of the lower container and thereafter again move the lower cones of the other pair of laterally opposite container devices on the rear side to the left to release the lower cones from the corresponding top corner fittings of the lower container.

Thus, during loading and unloading of containers, the operator is required to perform a complicated crane operation of separately engaging or releasing lower cones of each pair of container coupling devices on the front side and on the rear side with or from the top corner fittings of the lower container, and there is a problem in that much working time is needed accordingly. In particular, considering recent container ships, in which thousands of containers are loaded and unloaded, an increase in time needed to load or unload a single container leads to a significant decrease in transportation efficiency.

It should be noted that it also is conceivable to manufacture container coupling devices for use on the front side and container coupling devices for use on the rear side separately to make it possible to move the front and rear container coupling devices in the same direction. However, the manufacturing cost and the inventory cost increase. Also, inappropriate inventory management causes the container coupling devices for use on the front side and the container coupling devices for use on the rear side to be mixed, or it is difficult to completely prevent an operation error such as attachment of a container coupling device for use on the front side to the rear side or vice versa. If a container coupling device for the front side is attached to a corner fitting on the rear side due to an operation error during loading of a container, the container coupling device cannot be engaged with the top corner fitting of the lower container. In addition, if by any chance the device engages with the top corner fitting, the lower cone of the container coupling device cannot be released from the top corner fitting of the lower container, so that the need to, for example, cut the container coupling device or the corner fitting of the container arises, leading to a further decrease in the transportation efficiency.

Moreover, when an upper container is lifted in order to unload the container, the upper cones of the container coupling devices are pulled up via the engaged bottom corner fittings of the upper container, and then, the top corner fittings of a lower container, that is, the lower container is to be pulled up via the engaged lower cones. At this time, the front side or the rear side of the container is moved to the left or to the right, which is the direction in which the lower cones of the container coupling devices are released. Then, when the lower cones of the container coupling devices are to be rotated along an inner circumferential edge of the engaging holes of the top corner fittings of the lower container by means of the weight of the lower container, since the bottom corner fittings of the upper container and bottom surfaces of the upper cones of the container coupling devices engaged with the bottom corner fittings are in contact with each other over a large area, a frictional force proportional to the force that pulls up the upper container is generated during rotation of the upper cones. In that case, it is difficult to rotate the lower cones of the container coupling devices with respect to the engaging holes of the top corner fittings of the lower container, resulting in the disadvantage that the container coupling devices cannot be easily disengaged from the top corner fittings of the lower container.

Furthermore, during loading of containers, the engaging holes of the bottom corner fittings of an upper container are offset by a certain length in one lateral direction with respect to the engaging holes of the top corner fittings of a lower container. For this reason, when the operator engages the lower cones of the container coupling devices that are engaged with the bottom corner fittings of the upper container, the engaging holes of the top corner fittings of the lower container are hidden by the upper container, making it difficult to confirm the engaging holes, and thus, there also is the disadvantage that the engaging operation requires considerable skill.

Moreover, in the case where an upper container is coupled to a lower container by the container coupling device during loading of containers into a hold, it is necessary to couple the container coupling device in a state in which the upper container is moved in the lateral direction with respect to the lower container. Thus, if the upper container comes into contact with a guide rail of the hold or a laterally adjacent container, coupling of the upper container to the lower container by the container coupling device can no longer be performed. Also, during unloading of containers, in the case where a container to be unloaded is moved in the lateral direction in order to cancel the coupling by the container coupling device, if the container comes into contact with the guide rail of the hold or a laterally adjacent container, the container to be unloaded can no longer be unloaded. Thus, it is necessary to temporarily unload even containers around the container to be unloaded so as to secure a space for allowing movement of the container to be unloaded in the lateral direction, which makes the work troublesome.

In order to avoid the situations as described above, it is necessary that a space for allowing coupling by the container coupling device and release of the container coupling device, that is, a certain gap for allowing movement of a container in the lateral direction be secured between the container and an adjacent container or the guide rail of the hold in front and behind and on the right and left of the container. This significantly influences the load efficiency of containers in a limited space such as the hold.

The present invention has been made in view of the above-described issues, and it is an object thereof to provide a container coupling device with a simple structure, capable of automatically coupling a container to a lower container during loading of containers, automatically releasing a coupled container without involving high-place work or a complicated crane operation, and increasing the load efficiency of containers.

Solution to Problem

In order to achieve the above object, a container coupling device of the present invention includes a device main body having an upper fitted portion and a lower fitted portion that can be fitted into an engaging hole of a corner fitting of a container; a shaft that is rotatably supported in the device main body; an upper fitting and a lower fitting that are integrally connected to an upper end and a lower end, respectively, of the shaft so as to cross in an X shape as viewed from above and be concentric with an axis of the shaft and that are engageable with the corner fitting through the engaging hole thereof, and a spring means that is provided between the shaft and the device main body and that biases the upper fitting and the lower fitting so as to rotate the upper fitting and the lower fitting to a position at which the upper fitting and the lower fitting engage with the corner fitting. A lower half portion of the upper fitting and an upper half portion of the lower fitting are formed in such a shape that when the lower half portion or the upper half portion is pressed via the engaging hole of the corner fitting, a rotational force is applied in a direction in which the upper fitting and the lower fitting overlap the upper fitted portion and the lower fitted portion, respectively. When an upper container has been lifted with the upper fitting and the lower fitting being engaged with a corner fitting of the upper container and a corner fitting of a lower container, respectively, via the spring means, a container weight acts on the lower half portion of the upper fitting via the engaging hole of the corner fitting of the upper container and on the upper half portion of the lower fitting via the engaging hole of the corner fitting of the lower container. The upper fitting and the lower fitting rotate against a biasing force of the spring means in the direction in which the upper fitting and the lower fitting overlap the upper fitted portion and the lower fitted portion, respectively, and the lower fitting rotates to a position at which the lower fitting overlaps the lower fitted portion while the upper fitting is engaged with the corner fitting of the upper container.

According to the present invention, first, in the case of loading a container, the lower fitting is rotatively operated against the biasing force of the spring means to rotate the upper fitting to a position at which the upper fitting overlaps the upper fitted portion, and the upper fitting is inserted into the bottom corner fitting through the engaging hole of the bottom corner fitting of the container. Once the upper fitting has been inserted into the engaging hole of the bottom corner fitting, the rotation of the lower fitting is cancelled, whereby the upper fitting is rotated by the biasing force of the spring means to a position at which the upper fitting crosses the engaging hole of the bottom corner fitting of the container, and thus can be attached to the bottom corner fitting. In this state, if the lifted container is placed on top of a lower container, then, as is well known, the lower fitting, which is in a position at which the lower fitting crosses the engaging hole of the corner fitting of the container, rotates along the outer circumferential edge of the engaging hole of the top corner fitting of the container in the direction in which the lower fitting overlaps the lower fitted portion, and thus, the lower fitting can be inserted into the top corner fitting through the engaging hole. As a result, the upper and lower containers are coupled together by the upper fitting and the lower fitting of the container coupling device that are engaged with the bottom corner fitting of the upper container and the top corner fitting of the lower container, respectively.

On the other hand, in the case of unloading a container, when an upper container has been lifted, first, the inner circumferential edge of the engaging hole of the bottom corner fitting of the upper container presses against and raises the lower half portion of the upper fitting of the container coupling device, and also the upper half portion of the lower fitting is forced against the inner circumferential edge of the engaging hole of the top corner fitting of a lower container. Thus, the upper fitting and the lower fitting of the container coupling device are forcibly rotated against the biasing force of the spring means in the direction in which the upper fitting and the lower fitting overlap the upper fitted portion and the lower fitted portion, respectively. Then, when the lower fitting overlaps the lower fitted portion of the device main body as viewed from above, the lower fitting, together with the lower fitted portion of the device main body, can be released through the engaging hole of the top corner fitting of the container. At this time, the upper fitting is in a position at which the upper fitting still crosses the engaging hole of the bottom corner fitting of the upper container, and is therefore attached to the bottom corner fitting of the upper container and does in no way fall out of the lifted container.

In this manner, if a container with the container coupling device attached thereto by engaging the upper fitting with the bottom corner fitting of the container is transported and placed on top of a lower container, the lower fitting is inserted through the engaging hole of the top corner fitting of the lower container and subsequently engaged with the top corner fitting, and on the other hand, if the container is lifted, the engaged state of the lower fitting with the top corner fitting of the lower container can be cancelled. Thus, during loading of containers, vertically adjacent containers can be automatically coupled together by the container coupling device, and during unloading of containers, the container coupling device can be automatically released from the lower container.

Consequently, there is no need for the operator to operate a tool from, for example, on top of a container, so that work is lightened, and also it is no longer necessary to work at a high place, so that safety can be secured. In particular, during unloading of containers, since the lower half portion of the upper fitting and the upper half portion of the lower fitting of the container coupling device are formed in such a shape that a rotational force is applied in the direction in which the upper fitting and the lower fitting overlap the upper fitted portion and the lower fitted portion, respectively, the frictional force between the container coupling device and the corner fittings of the containers is reduced, which enables the upper fitting and the lower fitting to reliably rotate in the direction in which the upper fitting and the lower fitting overlap the upper fitted portion and the lower fitted portion, respectively. Moreover, since the center of an axis of the lower fitting coincides with the center of the upper fitting and the lower fitting, the operation of moving the lifted container in the lateral direction is not required, and in addition, there is no need to perform attachment and release of the container coupling device for each pair of container coupling devices on the front side and the rear side, and accordingly, operations can be easily performed and loading and unloading of containers can be performed in a short period of time. Furthermore, it is not necessary to leave a gap for coupling or uncoupling by the container coupling device in between laterally adjacent containers, so that the load efficiency of containers into a hold or the like can be increased.

Moreover, a container coupling device of the present invention includes a device main body having an upper fitted portion and a lower fitted portion that can be fitted into an engaging hole of a corner fitting of a container; a shaft that is rotatably supported in the device main body; an upper fitting and a lower fitting that are integrally connected to an upper end and a lower end, respectively, of the shaft so as to cross in an X shape as viewed from above and be concentric with an axis of the shaft and that are engageable with the corner fitting through the engaging hole thereof and a spring means that is provided between the shaft and the device main body and that biases the upper fitting and the lower fitting so as to rotate the upper fitting and the lower fitting to a position at which the upper fitting and the lower fitting engage with the corner fitting. A lower half portion of the upper fitting and an upper half portion of the lower fitting are formed in such a shape that when the lower half portion or the upper half portion is pressed via the engaging hole of the corner fitting, a rotational force is applied in a direction in which the upper fitting and the lower fitting overlap the upper fitted portion and the lower fitted portion, respectively. A locking portion that can be locked by an inner circumferential surface of the engaging hole of the corner fitting is formed at least on a top surface of the upper fitted portion in such a manner that the locking portion does not interfere with rotation of the upper fitting. When an upper container has been lifted with the upper fitting and the lower fitting being engaged with a corner fitting of the upper container and a corner fitting of a lower container, respectively, via the spring means, the locking portion of the upper fitted portion is locked by the inner circumferential surface of the engaging hole of the corner fitting of the upper container, and a container weight acts on the lower half portion of the upper fitting via the engaging hole of the corner fitting of the upper container and on the upper half portion of the lower fitting via the engaging hole of the corner fitting of the lower container. The upper fitting and the lower fitting rotate against a biasing force of the spring means in the direction in which the upper fitting and the lower fitting overlap the upper fitted portion and the lower fitted portion, respectively, and the lower fitting rotates to a position at which the lower fitting overlaps the lower fitted portion while the upper fitting is engaged with the corner fitting of the upper container.

According to the present invention, first, in the case of loading a container, the lower fitting is rotatively operated against the biasing force of the spring means to rotate the upper fitting to the position at which the upper fitting overlaps the upper fitted portion, and through the engaging hole of a bottom corner fitting of the container, the upper fitting is inserted into the bottom corner fitting. Once the upper fitting has been inserted into the engaging hole of the bottom corner fitting, the rotation of the lower fitting is cancelled, whereby the upper fitting is rotated by the biasing force of the spring means to the position at which the upper fitting crosses the engaging hole of the bottom corner fitting of the container, and thus can be attached to the bottom corner fitting. In this state, if the lifted container is placed on top of a lower container, then, as is well known, the lower fitting, which is in the position at which the lower fitting crosses engaging hole of the corner fitting of the container, rotates along the outer circumferential edge of the engaging hole of the top corner fitting of the container in the direction in which the lower fitting overlaps the lower fitted portion, and thus, the lower fitting can be inserted into the top corner fitting through the engaging hole. As a result, the upper and lower containers can be coupled together by the upper fitting and the lower fitting of the container coupling device that are engaged with the bottom corner fitting of the upper container and the top corner fitting of the lower container, respectively.

On the other hand, in the case of unloading a container, when an upper container has been raised, first, the inner circumferential edge of the engaging hole of the bottom corner fitting of the upper container presses against and raises the lower half portion of the upper fitting of the container coupling device, and also the upper half portion of the lower fitting is forced against the inner circumferential edge of the engaging hole of the top corner fitting of a lower container. Thus, the upper fitting and the lower fitting of the container coupling device are forcibly rotated against the biasing force of the spring means in the direction in which the upper fitting and the lower fitting overlap the upper fitted portion and the lower fitted portion, respectively. Then, when the lower fitting overlaps the lower fitted portion of the device main body as viewed from above, the lower fitting, together with the lower fitted portion of the device main body, can be released through the engaging hole of the top corner fitting of the container. At this time, the upper fitting is in a position at which the upper fitting still crosses the engaging hole of the bottom corner fitting of the upper container, and also the locking portion of the upper fitted portion is locked by the inner circumferential surface of the engaging hole of the bottom fitting of the upper container. Therefore, the container coupling device is prevented from accidentally rotating with respect to the bottom corner fitting of the upper container, so that the container coupling device is reliably attached to the bottom corner fitting of the upper container and does in no way fall out of the lifted container.

In this manner, if a container with the container coupling device attached thereto by engaging the upper fitting with the bottom corner fitting of the container is transported and placed on top of a lower container, the lower fitting is inserted through the engaging hole of the top corner fitting of the lower container and subsequently engaged with the top corner fitting, and on the other hand, if the container is raised, the engaged state of the lower fitting with the top corner fitting of the lower container can be cancelled. Thus, during loading of containers, vertically adjacent containers can be automatically coupled together by the container coupling device, and during unloading of containers, the container coupling device can be automatically released from the lower container in a state in which the container coupling device is reliably attached to the upper container without rotating.

Consequently, there is no need for the operator to operate a tool from, for example, on top of a container, so that work is lightened, and also it is no longer necessary to work at a high place, so that safety can be secured. In particular, during unloading of containers, since the lower half portion of the upper fitting and the upper half portion of the lower fitting of the container coupling device are formed in such a shape that a rotational force is applied in the direction in which the upper fitting and the lower fitting overlap the upper fitted portion and the lower fitted portion, respectively, the frictional force between the container coupling device and the corner fittings of the containers is reduced, which enables the upper fitting and the lower fitting to reliably rotate in the direction in which the upper fitting and the lower fitting overlap the upper fitted portion and the lower fitted portion, respectively. Furthermore, since the locking portion of the upper fitted portion is locked by the inner circumferential surface of the engaging hole of the bottom corner fitting of the lifted container, thereby preventing the container coupling device from accidentally rotating with respect to the bottom corner fitting, the container coupling device can be reliably retained by the bottom corner fitting of the lifted container without falling out. Moreover, since the center of an axis of the lower fitting coincides with the center of the upper fitting and the lower fitting, the operation of moving the lifted container in the lateral direction is not required, and in addition, there is no need to perform attachment and release of the container coupling device for each pair of container coupling devices on the front side and the rear side, and accordingly, operations can be easily performed and loading and unloading of containers can be performed in a short period of time. Furthermore, it is not necessary to leave a gap for performing coupling or uncoupling by the container coupling device in between laterally adjacent containers, so that the load efficiency of containers into the hold or the like can be increased.

In the present invention, preferably, an operating member for rotating the shaft is provided. Thus, the upper fitting can be rotated to and retained in the position at which the upper fitting overlaps the upper fitted portion by rotating the shaft by operating the operating member, and this facilitates attachment of the container coupling device. Moreover, in case of an emergency such as a breakdown, the lower fitting can be rotated to and retained in the position at which the lower fitting overlaps the lower fitted portion by rotating the shaft by operating the operating member, and this enables release of the upper container from the lower container.

In the present invention, preferably, a flag that enables visual observation of a rotation position of the shaft is provided. Thus, it is possible to reliably know from the position of the flag whether the shaft is in the first rotation position, that is, the state in which the upper fitting and the lower fitting are engaged with the bottom corner fitting of the upper container and the top corner fitting of the lower container, respectively; in the second rotation position, that is, the state in which the upper fitting is engaged with the bottom corner fitting of the upper container and the lower fitting is in the position at which the lower fitting overlaps the lower fitted portion and therefore can be released from the top corner fitting of the lower container; or in the third rotation position, that is, the state in which the upper fitting is in the position at which the upper fitting overlaps the upper fitted portion and therefore can be released from the bottom corner fitting of the upper container, and the lower fitting is engaged with the top corner fitting of the lower container. Thus, during loading and unloading of containers, operations can be performed while externally knowing the relationship of the upper fitting and the lower fitting of the container coupling device.

Advantageous Effects of Invention

According to the present invention, even though the structure is very simple, a container to be loaded can be automatically and reliably coupled to a lower container simply by placing the container to be loaded on top of the lower container. Moreover, the coupled upper container can be automatically and reliably released from the lower container simply by lifting the upper container, so that the need for operation of a tool and high-place work is eliminated, and also there is no need for a complicated crane operation. Accordingly, loading and unloading of containers can be performed in a short period of time, and the gap between two containers that are adjacent in the front-and-rear direction and the lateral direction can be minimized, and therefore, the load efficiency of containers can be increased.

DESCRIPTION OF REFERENCE NUMERALS

Figure 1:
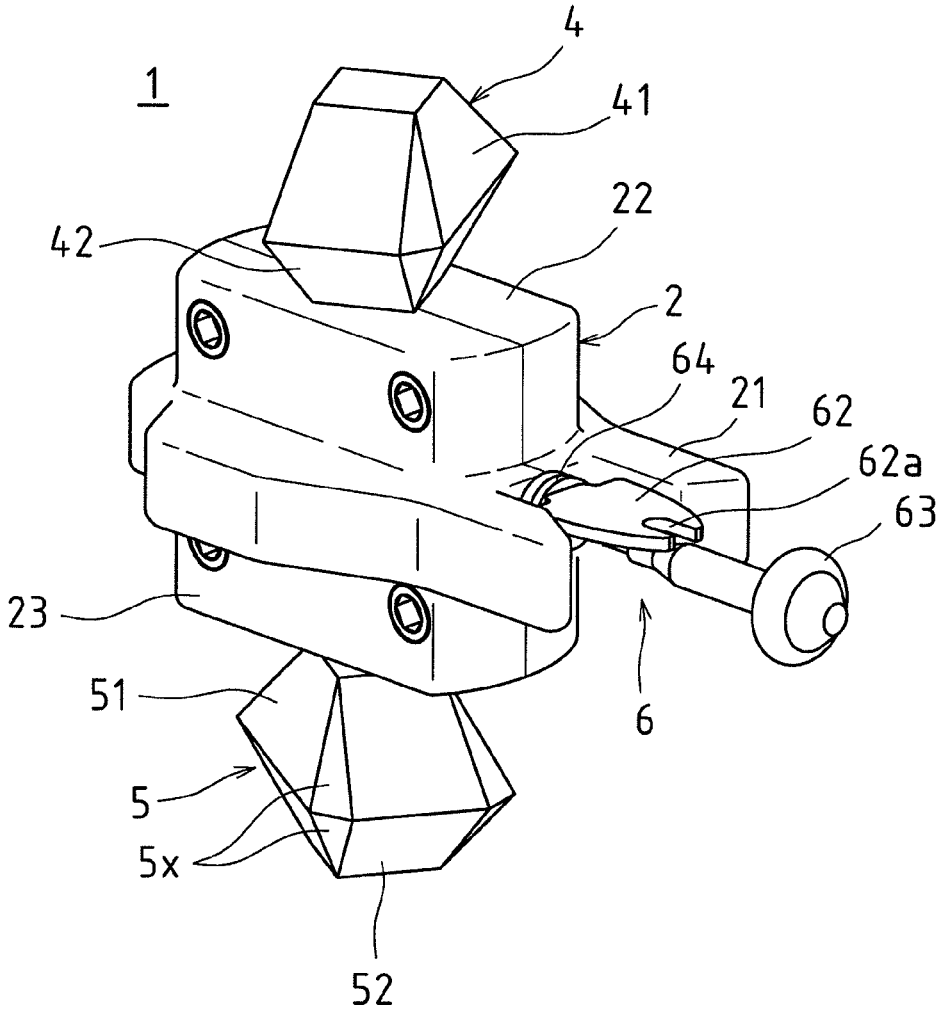
FIG. 1 is a perspective view showing a container coupling device according to a first embodiment of the present invention.
Figure 2:
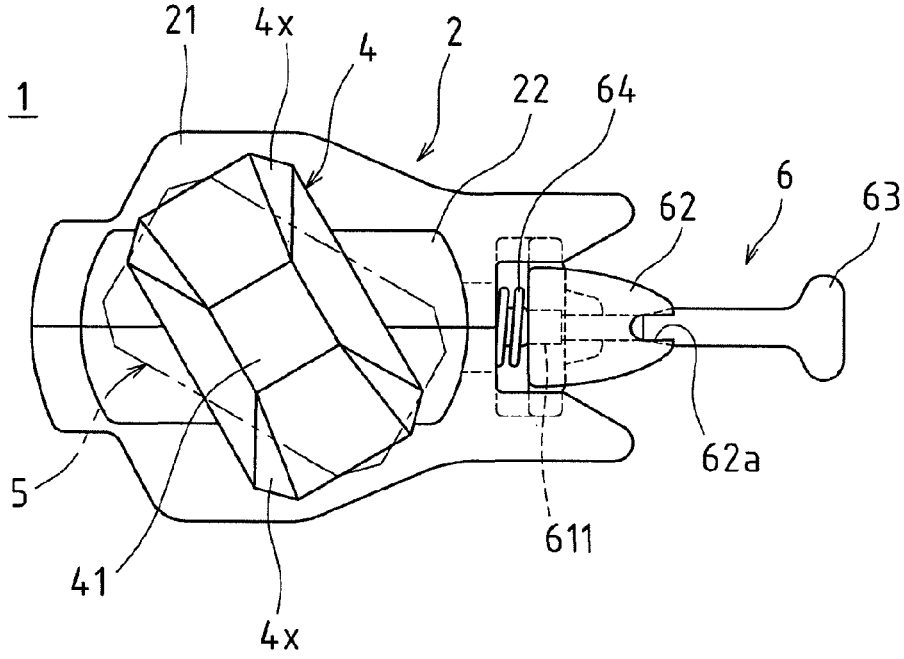
FIG. 2 is a plan view of the container coupling device in FIG. 1.
Figure 3:
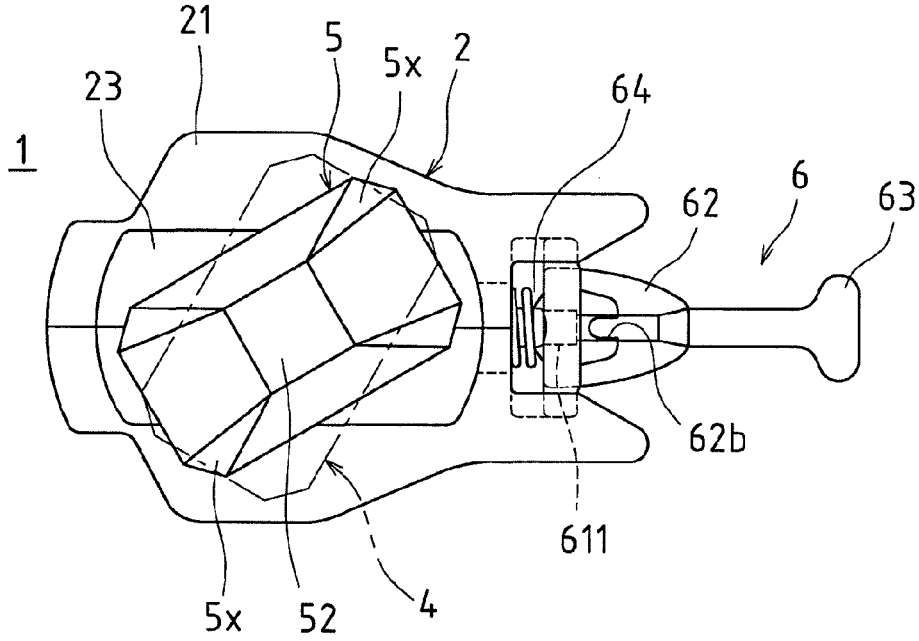
FIG. 3 is a bottom view of the container coupling device in FIG. 1.

1 Container coupling device
2 Device main body
2V Locking portion
22 Upper fitted portion
23 Lower fitted portion
3 Shaft
32 Arm
33 Torsion spring (spring means)
4 Upper fitting
5 Lower fitting
41, 51 Upper half portion
42, 52 Lower half portion
4*x*,5*x* Sloping surface
6 Operating member
63 Operation knob
Ct Container
F Corner fitting
Fa Engaging hole

DESCRIPTION OF EMBODIMENTS

Hereinafter, embodiments of the present invention will be described based on the drawings.

First Embodiment

FIGS. 1 to 4 show a container coupling device according to a first embodiment of the present invention.

A container coupling device 1 includes, as its main parts, a device main body 2, a shaft 3, an upper fitting 4, a lower fitting 5, and an operating member 6, for example. The device main body 2 can be divided into two parts, and the two parts are fastened to each other into a single unit by a bolt. The shaft 3 is axially supported in the device main body 2 in a rotatable manner. The upper fitting 4 and the lower fitting 5 are integrally connected to an upper end and a lower end, respectively, of the shaft 3. The operating member 6 rotates the shaft 3, the upper fitting 4, and the lower fitting 5.

Figure 20:
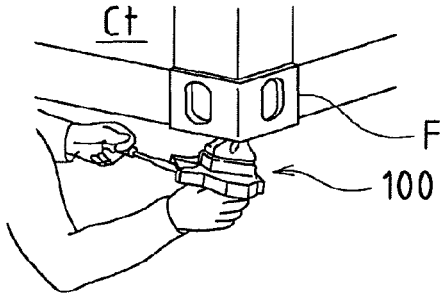
FIGS. 20(*a*) to 20(*e*) are process drawings for explaining attachment of the container coupling device in FIG. 16 to a container and loading of the container onto the container ship, and unloading of the container loaded on the container ship.
Figure 20:
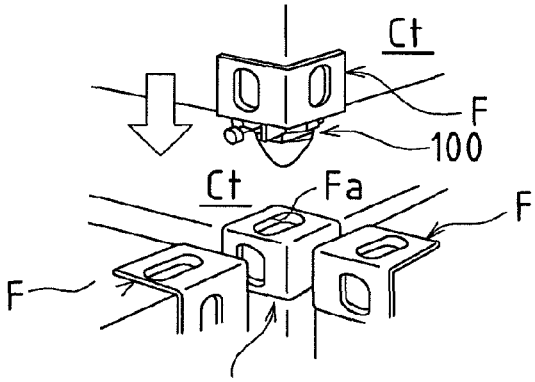
Figure 20:
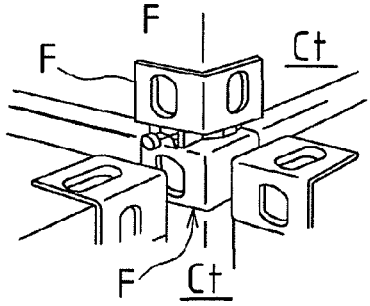
Figure 20:
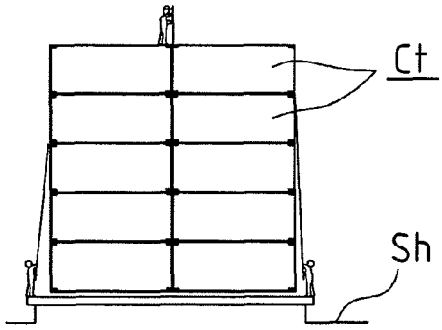
Figure 20:
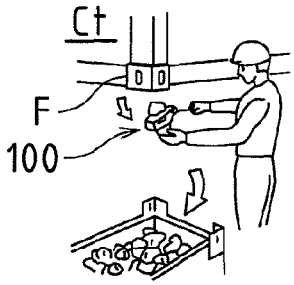

The device main body 2 has a main body portion 21 that is larger than an engaging hole Fa (see FIG. 20(*b*)) of a corner fitting F of a container Ct. Moreover, the device main body 2 includes an upper fitted portion 22 and a lower fitted portion 23 that are integrally formed in an upper part and a lower part, respectively, of the main body portion 21, and the upper and lower fitted portions have a shape substantially matching the engaging hole Fa of the corner fitting F of the container Ct as viewed from above. These upper fitted portion 22 and lower fitted portion 23 are adapted to fit into the engaging hole Fa of a bottom corner fitting F of an upper container Ct and the engaging hole Fa of a top corner fitting F of a lower container Ct. Moreover, a through hole (not shown) extending entirely through the device main body 2 from a top surface of the upper fitted portion 22 to a bottom surface of the lower fitted portion 23 is formed, and this through hole supports the shaft 3 in a rotatable manner.

Figure 4:
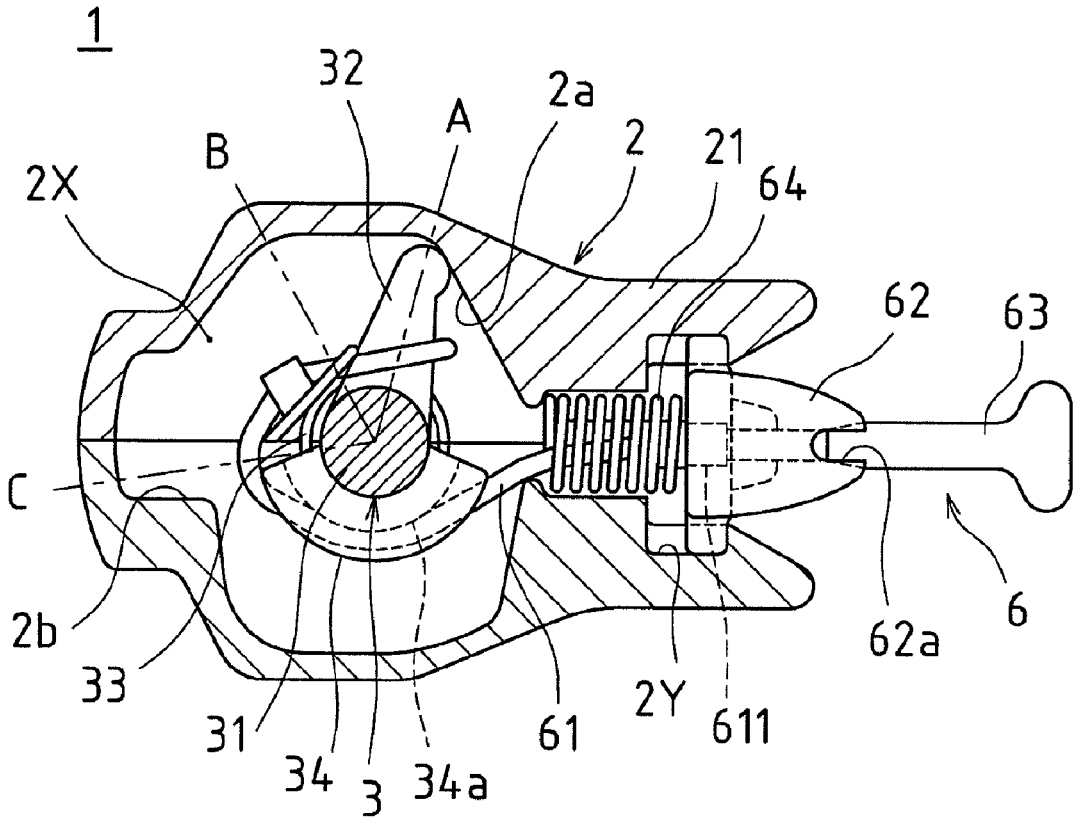
FIG. 4 is a transverse cross-sectional view of the container coupling device in FIG. 1.

Furthermore, as shown in FIG. 4, a cavity 2X having a first locking portion 2*a* and a second locking portion 2*b* against which an arm 32 (described later) integrally fixed to the shaft 3 can abut is formed inside the device main body 2, and the shaft 3 is adapted to rotate between a first rotation position A at which the arm 32 abuts against the first locking portion 2*a* of the cavity 2X and a third rotation position C at which the arm abuts against the second locking portion 2*b*.

The shaft 3 is configured of a shaft portion 31 having an outer diameter corresponding to the hole diameter of the through hole of the device main body 2, the arm 32 integrally fixed to substantially the middle of the shaft portion 31 and protruding therefrom, a spring means, such as a torsion spring 33, disposed on a lower part of the shaft portion 31, and a substantially semicircular guide portion 34 having a groove 34*a* formed in an outer circumference thereof and integrally fixed to substantially the middle of the shaft portion 31. The arm 32, torsion spring 33, and guide portion 34 are housed in the cavity 2X of the device main body 2. The torsion spring 33 is anchored to the device main body 2 at one end and to the shaft 3 at the other end. The arm 31 of the shaft 3 is biased by a biasing force of this torsion spring 33 so as to rotate in a direction in which the arm abuts against the first locking portion 2*a* of the cavity 2X.

The upper fitting 4 and the lower fitting 5 are engageable with the engaging hole Fa of a corner fitting F of a container Ct and are each formed corresponding to the engaging hole Fa of the corner fitting F. In the illustrative form, the upper fitting 4 and the lower fitting 5 are formed in a substantially abacus bead shape.

The upper fitting 4 and the lower fitting 5 rotate on the top surface of the upper fitted portion 22 and the bottom surface of the lower fitted portion 23, respectively, of the device main body 2 with the rotation of the shaft 3. Moreover, the upper fitting 4 and the lower fitting 5 are integrally connected to the shaft 3 so as to cross in an X shape as viewed from above and be concentric with a rotation axis of the shaft 3 so that when the upper fitting 4 is inserted into or released from the engaging hole Fa of a bottom corner fitting F of an upper container Ct, the lower fitting 5 crosses the engaging hole Fa of a top corner fitting F of a lower container Ct, and that when the lower fitting 5 is inserted into or released from the engaging hole Fa of the top corner fitting F of the lower container Ct, the upper fitting 4 crosses the engaging hole Fa of the bottom corner fitting F of the upper container Ct.

Here, the upper fitting 4 and the lower fitting 5 are each formed in such a shape that when the upper or the lower fitting is in a positional relationship that the upper or the lower fittings crosses the engaging hole Fa of a corner fitting F, when the upper or the lower fitting is forced against the engaging hole Fa of the corner fitting F, a rotational force is applied to the upper or the lower fitting in a direction in which the upper fitting or the lower fitting overlaps the upper fitted portion 22 or the lower fitted portion 23, respectively.

Specifically, the upper fitting 4 and the lower fitting 5 are each formed in a substantially abacus bead shape in which like bases of an upper half portion 41 or 51 and a lower half portion 42 or 52 having substantially the same truncated pyramid shape are joined one on top of the other with their virtual apexes being separated from each other. Moreover, in the upper fitting 4 and the lower fitting 5, edges between adjacent lateral faces of the upper half portions 41 and 51 and lower half portions 42 and 52 of the truncated pyramid shape are chamfered to form sloping surfaces 4*x* and 5*x* having a substantially triangular shape whose width gradually increases from top to bottom in the case of the upper half portions 41 and 51 or from bottom to top in the case of the lower half portions 42 and 52.

Therefore, a configuration is adopted in which, when the upper fitting 4 and the lower fitting 5 are each in a position at which the upper or the lower fitting crosses the engaging hole Fa of a corner fitting F, a pair of diagonally opposite sloping surfaces 4x or 5x of the upper half portion 41 or 51 and the lower half portion 42 or 52 of the upper fitting 4 or the lower fitting 5, or otherwise a pair of diagonally opposite edges among edges between the sloping surfaces 4x or 5x and the lateral faces that are rotating in an engagement direction, opposes a circumferential edge of the engaging hole Fa of the corner fitting F.

Figure 5:
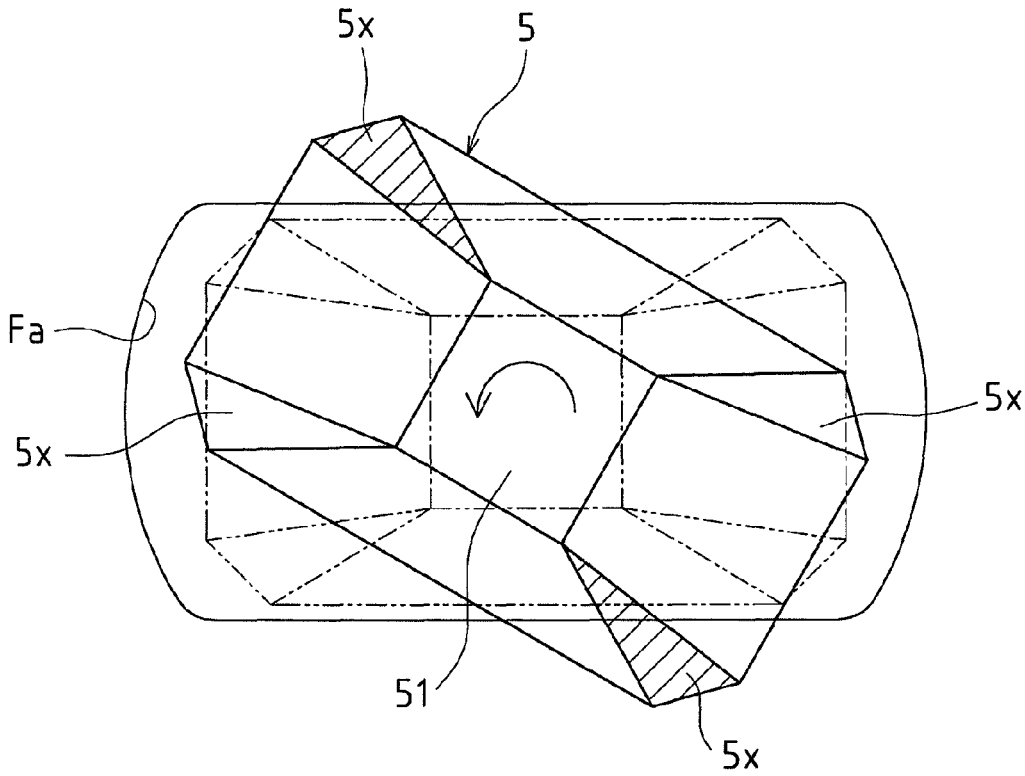
FIG. 5 is a diagram for explaining the relationship between an upper fitting and a lower fitting of the container coupling device in FIG. 1 and an engaging hole of a corner fitting of a container by schematically showing an upper half portion of the lower fitting and the engaging hole of the corner fitting as an example.

Here, a form related to the upper fitting and lower fitting of the container coupling device in FIG. 1 and the engaging hole of a corner fitting of a container will be described with reference to FIG. 5. FIG. 5 is an explanatory plan view showing the upper half portion 51 of the lower fitting 5 and the engaging hole Fa of a corner fitting F as an example.

In a state in which the lower fitting 5 crosses the engaging hole Fa of the corner fitting F, the upper half portion 51 or the lower half portion 52 of the lower fitting 5 is brought into contact with and forced against the circumferential edge of the engaging hole Fa of the corner fitting F. Then, the lower fitting 5 receives a reaction force via a pair of diagonally opposite sloping surfaces 5x that are rotating in the engagement direction, or otherwise a pair of diagonally opposite edges among edges defined by the sloping surfaces 5x and the lateral faces that are rotating in the engagement direction. The reaction force acting on the lower fitting 5 causes the lower fitting 5 to rotate around the center of the rotation axis of the shaft 3 against the biasing force of the torsion spring 33 in a direction in which the lower fitting 5 overlaps the lower fitted portion 23.

This configuration also applies to a state in which the upper fitting 4 crosses the engaging hole Fa of a corner fitting F. In the state in which the upper fitting 4 crosses the engaging hole Fa of the corner fitting F, the upper half portion 41 or the lower half portion 42 of the upper fitting 4 is brought into contact with and forced against the circumferential edge of the engaging hole Fa of the corner fitting F. The reaction force received by the upper fitting 4 as a result of pressing causes the upper fitting 4 to rotate around the center of the rotation axis of the shaft 3 against the biasing force of the torsion spring 33 in a direction in which the upper fitting 4 overlaps the upper fitted portion 22.

A loop portion at one end of the operating member 6 is inserted through the arm 32 of the shaft 3. The operating member 6 is constituted by a wire 61 wound on the groove 34*a* of the guide portion 34 provided on the shaft 3, a mouthpiece 62 whose right and left ends are both slidably fitted in a guide 2Y of the device main body 2, and an operation knob 63 anchored to the other end of the wire 61 that is led to the outside of the device main body 2 through the mouthpiece 62. The mouthpiece 62 is biased by a spring 64 disposed in the device main body 2 so as to abut against an end of the guide 2Y. A locking portion 611 is formed in the vicinity of the other end of the wire 61, and this locking portion 611 can be selectively locked in slots 62*a* and 62*b* that are formed in an upper part and a lower part of the mouthpiece 62.

Next, the operation of the container coupling device 1 having the above-described configuration will be described.

In the container coupling device 1, in an initial state, the shaft 3 is in the first rotation position A at which the arm 32 abuts against the first locking portion 2*a* of the cavity 2X of the device main body 2 due to the biasing force of the torsion spring 33. Moreover, the upper fitting 4 and the lower fitting 5 are in positions at which the upper and the lower fittings cross the engaging hole Fa of a bottom corner fitting F of a container Ct with the upper fitting 4 being at a set angle ahead of the lower fitting 5.

Figure 6:
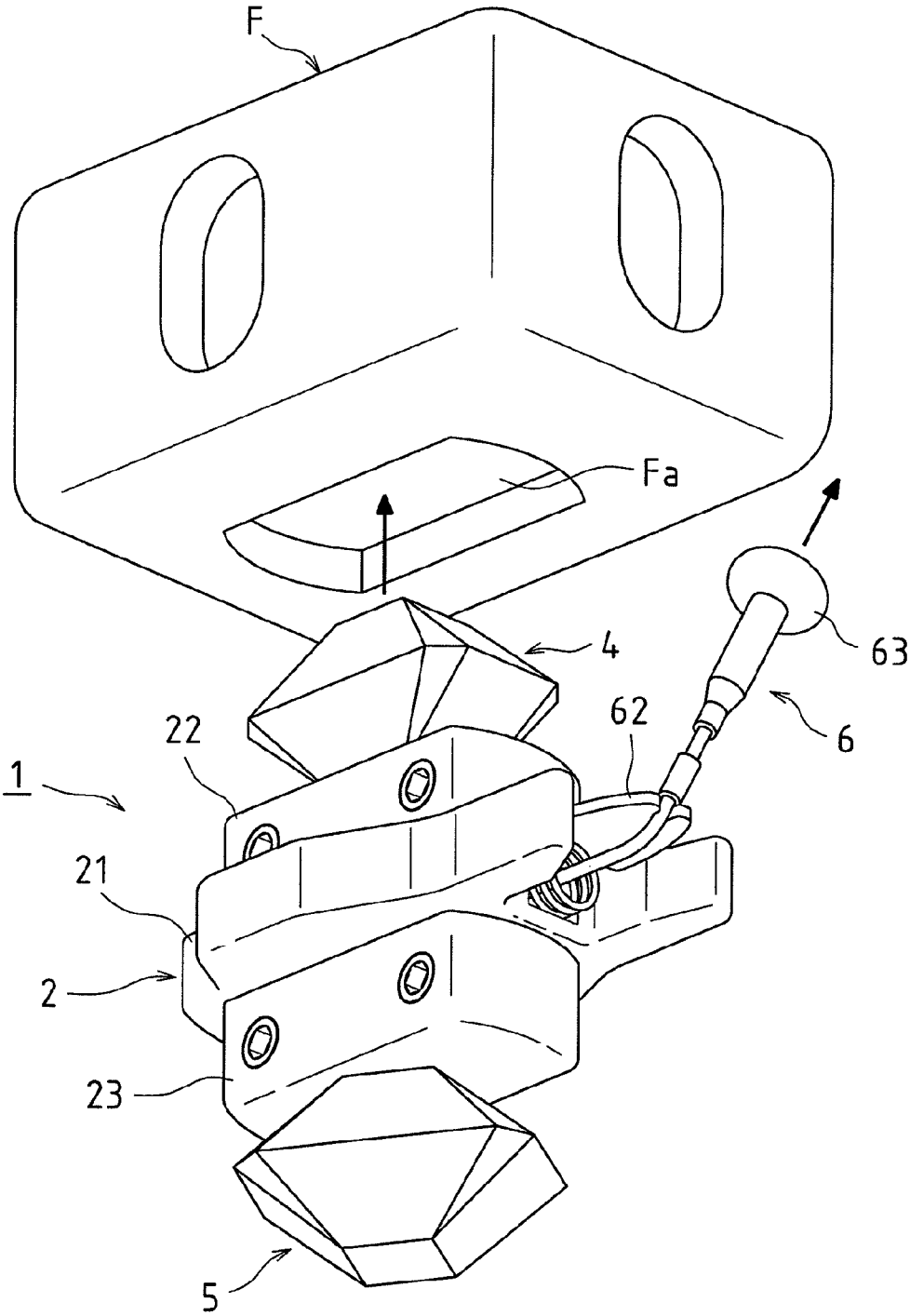
FIG. 6 is a perspective view showing how the container coupling device in FIG. 1 is attached to a bottom corner fitting of a container.

In order to attach the container coupling device 1 to the corner fitting F of the container Ct, the operation knob 63 is grasped and pulled to lock the locking portion 611 of the wire 61 in the slot 62*a* of the mouthpiece 62. In this state, the shaft 3 has rotated against the biasing force of the torsion spring 33 and reached the third rotation position C at which the arm 32 abuts against the second locking portion 2*b* of the cavity 2X of the device main body 2. Moreover, the upper fitting 4 is in a position at which the upper fitting 4 overlaps the upper fitted portion 22 of the device main body 2 as viewed from above. Thus, as shown in FIG. 6, the upper fitting 4, together with the upper fitted portion 22 of the device main body 2, can be inserted into the engaging hole Fa of the bottom corner fitting F of the upper container Ct.

Figure 7:
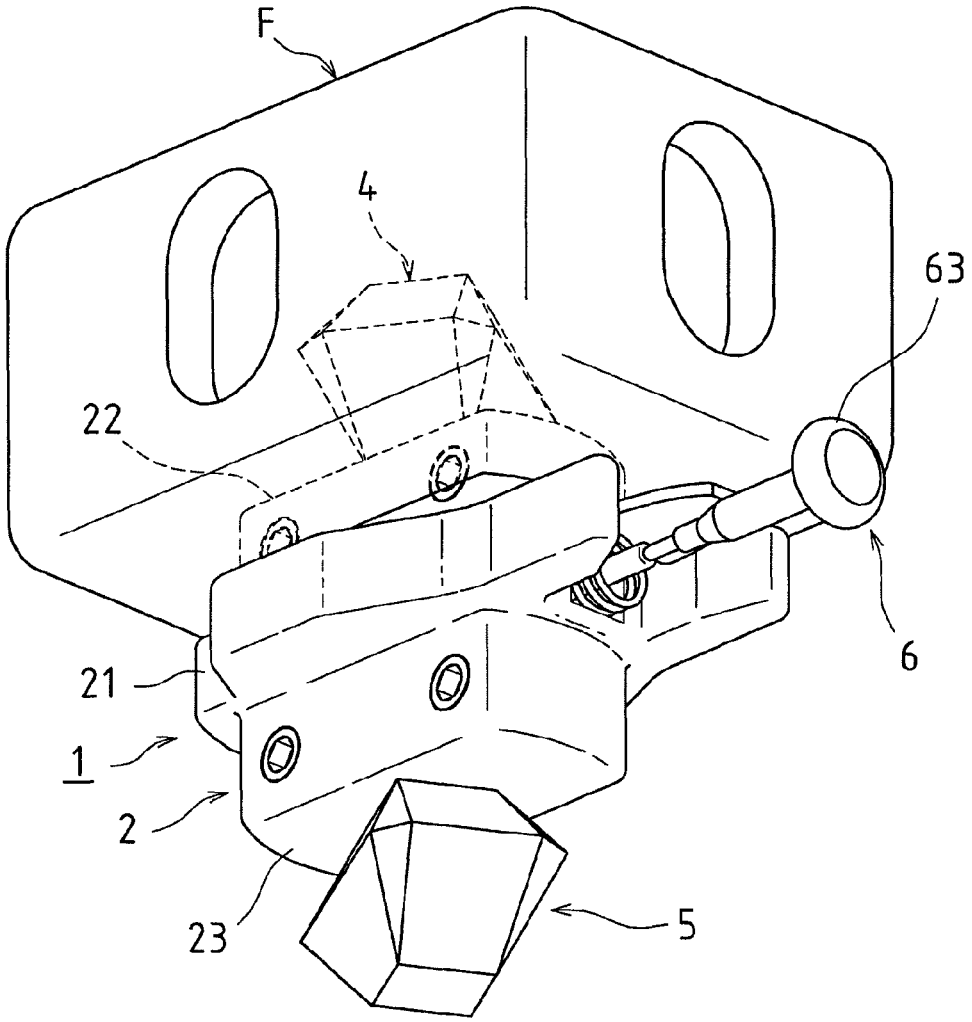
FIG. 7 is a perspective view showing a state in which the container coupling device in FIG. 1 has been attached to the bottom corner fitting of the container.

Once the upper fitting 4 has been inserted into the engaging hole Fa of the corner fitting F, the operation knob 63 is again grasped and pulled to release the locking portion 611 of the wire 61 from the slot 62*a* of the mouthpiece 62. Then, due to the biasing force of the torsion spring 33, the shaft 3 returns to the first rotation position A at which the arm 32 abuts against the first locking portion 2*a* of the cavity 2X of the device main body 2. As described above, in this state, the upper fitting 4 and the lower fitting 5 of the container coupling device 1 are in the positions at which the upper and the lower fittings individually cross the engaging hole Fa of the corner fitting F. Thus, as shown in FIG. 7, the upper fitting 4 is engaged with the corner fitting F, and the container coupling device 1 can be retained without falling out.

Figure 8:
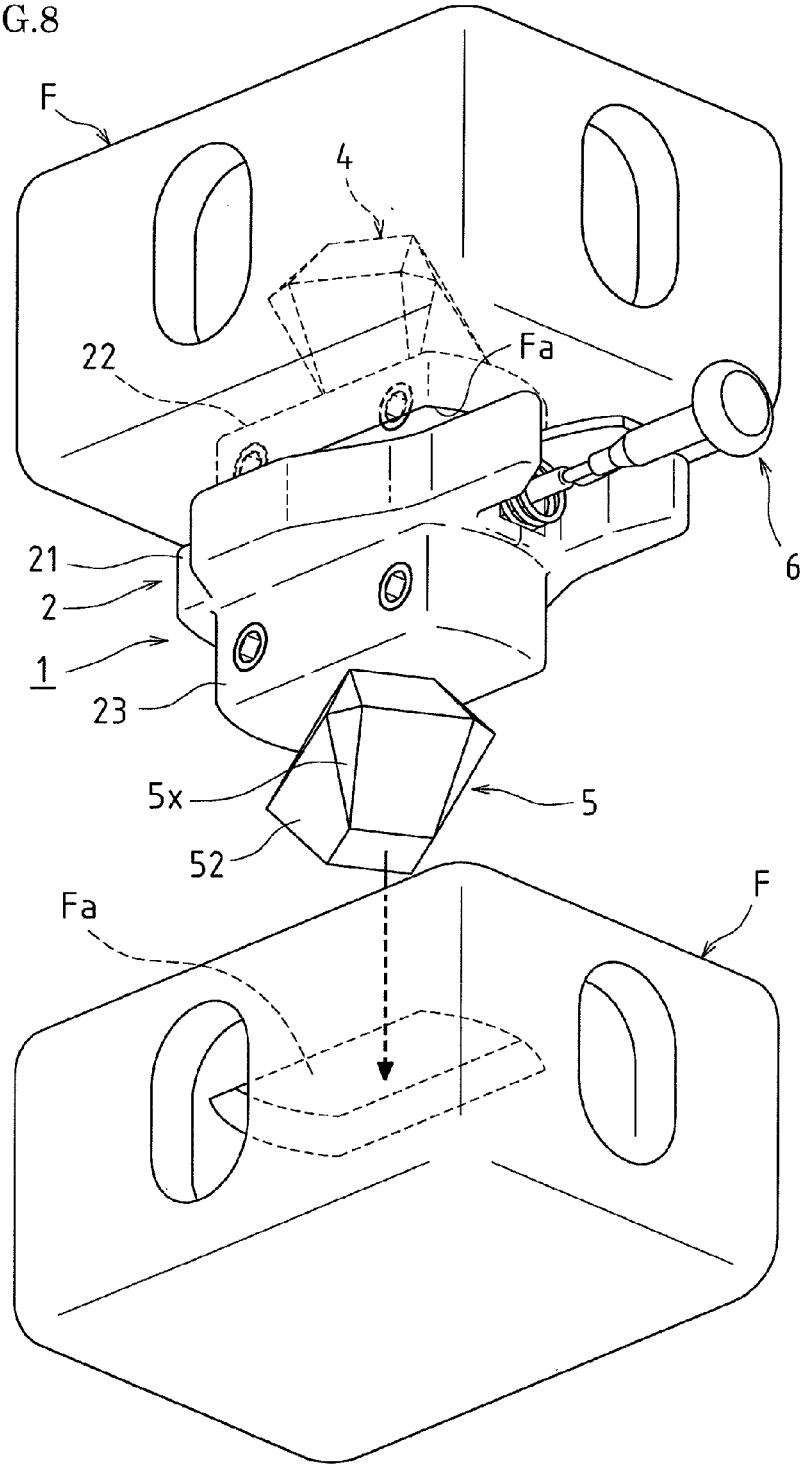
FIG. 8 is a perspective view showing how the container coupling device in FIG. 1 that has been attached to the bottom corner fitting of the container is attached to a top corner fitting of another container.
Figure 9:
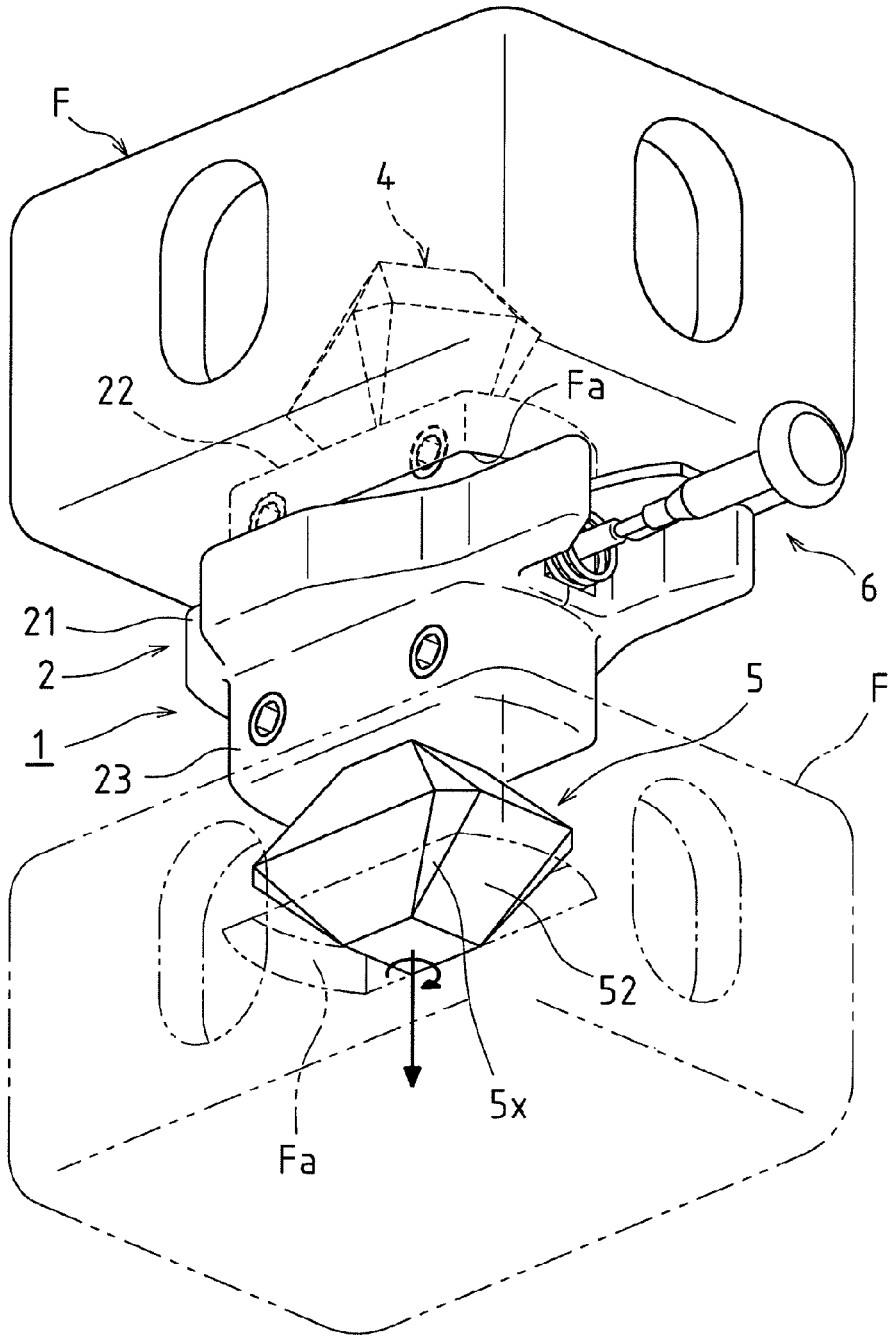
FIG. 9 is a perspective view showing how the container coupling device in FIG. 1 that has been attached to the bottom corner fitting of the container is attached to the top corner fitting of the other container.

Once the container coupling device 1 has been attached to the bottom corner fitting F of the container Ct, the container Ct is lifted with a container crane Cr and placed on top of another container Ct on a deck of a container ship Sh. At this time, as shown in FIG. 8, the lower fitting 5 of the container coupling device 1 is inserted into the engaging hole Fa of a top corner fitting F of the lower container Ct and forced against the outer circumferential edge of the engaging hole Fa under the weight of the upper container Ct. That is to say, the sloping surfaces 5x or a pair of edges of the lower half portion 52 of the lower fitting 5 are forced against the outer circumferential edge of the engaging hole Fa of the top corner fitting F of the lower container Ct. Thus, the lower fitting 5 receives the reaction force via the pair of sloping surfaces 5x or the pair of edges forced against the outer circumferential edge of the engaging hole Fa. As shown in FIG. 9, the lower fitting 5 is forcibly rotated around the center of the rotation axis of the shaft 3 against the biasing force of the torsion spring 33 along the outer circumferential edge of the engaging hole Fa of the top corner fitting F of the lower container Ct in the direction in which the lower fitting 5 overlaps the lower fitted portion 23.

Figure 10:
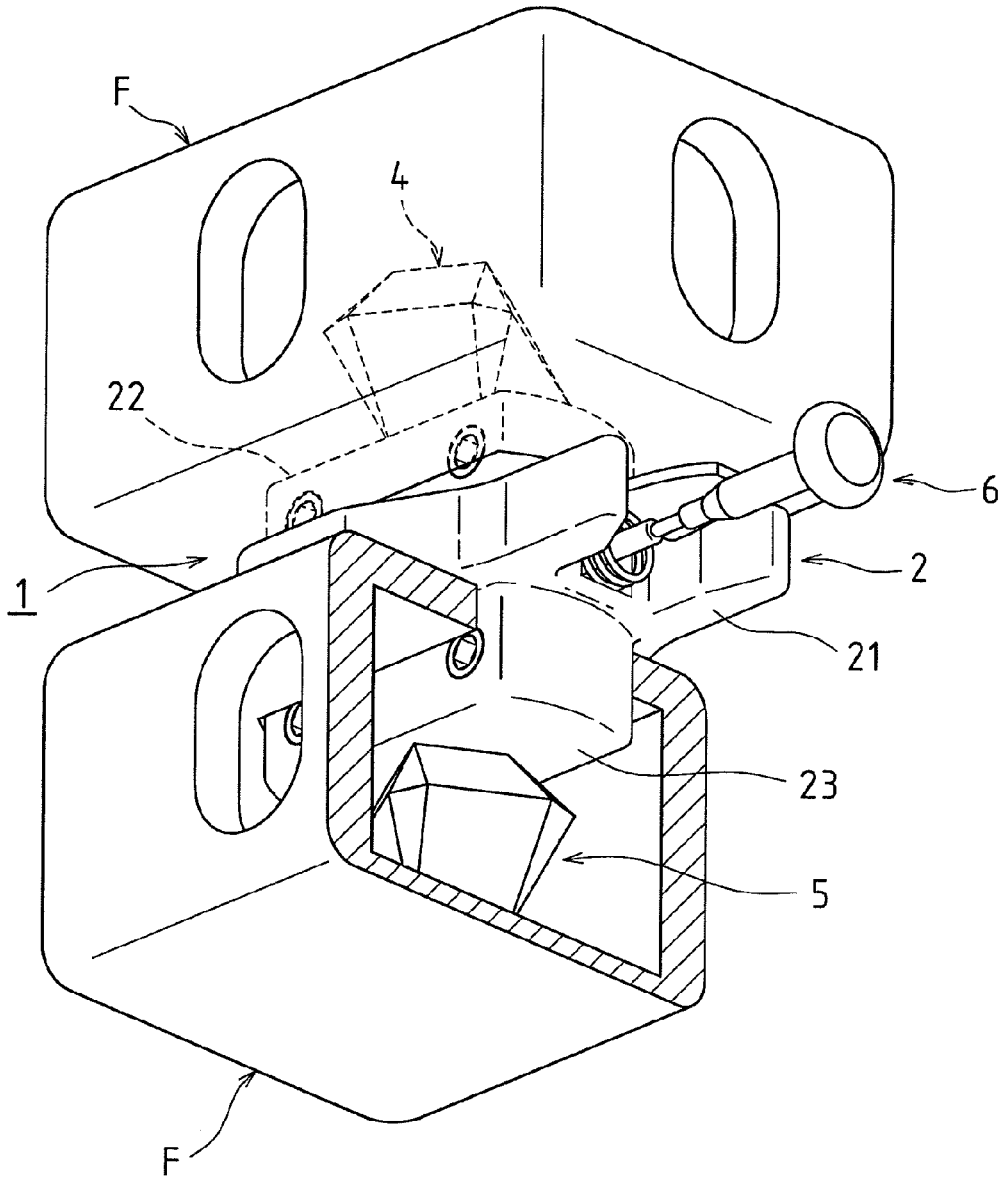
FIG. 10 is a partially cutaway perspective view showing a state in which the upper fitting and the lower fitting of the container coupling device in FIG. 1 have been engaged with the bottom corner fitting and the top corner fitting of the containers, respectively, and the vertically adjacent containers have been coupled together.

Then, when the lower fitting 5 overlaps the lower fitted portion 23 of the device main body 2 as viewed from above, the lower fitting 5, together with the lower fitted portion 23 of the device main body 2, is fitted into the engaging hole Fa of the top corner fitting F of the lower container Ct. Once the lower fitting 5 has been fitted into the top corner fitting F, the lower fitting 5 again returns to the position at which the lower fitting 5 crosses the engaging hole Fa of the corner fitting F due to the biasing force of the torsion spring 33, and thus engages with the corner fitting F. As a result, the upper and lower containers Ct are coupled together by the upper fitting 4 and the lower fitting 5 of the container coupling device 1 engaged with the bottom corner fitting F of the upper container Ct and the top corner fitting F of the lower container Ct, respectively, as shown in FIG. 10.

Figure 11:
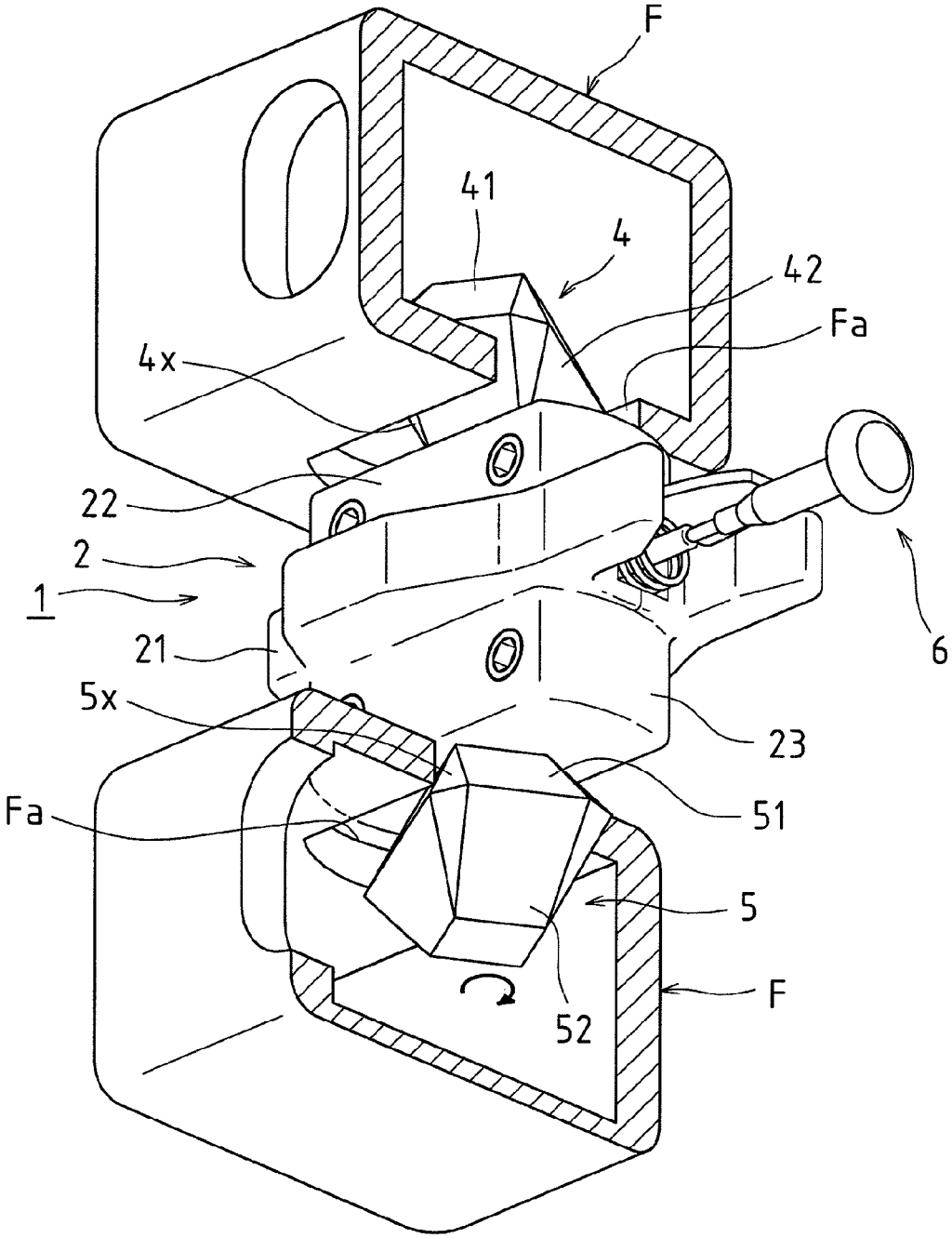
FIG. 11 is a perspective view showing a state of the container coupling device in FIG. 1 during uncoupling of the upper container and the lower container coupled together by the container coupling device, the corner fittings being partially cut away.

On the other hand, in the case of unloading containers Ct from the deck of the container ship Sh, the upper container Ct is lifted. Then, an inner circumferential edge of the engaging hole Fa of the bottom corner fitting F of the upper container Ct presses against the lower half portion 42 of the upper fitting 4 of the container coupling device 1 and the container coupling device 1 is raised. Moreover, the upper half portion 51 of the lower fitting 5 is forced against the inner circumferential edge of the engaging hole Fa of the top corner fitting F of the lower container Ct. As a result, a pair of diagonally opposite sloping surfaces 4*x* that are rotating in the engagement direction, or otherwise a pair of diagonally opposite edges among the edges defined by the sloping surfaces 4*x* and the lateral faces that are rotating in the engagement direction, of the lower half portion 42 of the upper fitting 4 of the container coupling device 1 is forced against the inner circumferential edge of the engaging hole Fa of the bottom corner fitting F of the upper container Ct, and thus, the upper fitting 4 receives the reaction force via the pair of sloping surfaces 4*x*, or the pair of diagonally opposite edges that are rotating in the engagement direction, forced against the inner circumferential edge of the engaging hole Fa. Similarly, a pair of diagonally opposite sloping surfaces 5*x* that are rotating in the engagement direction, or otherwise a pair of diagonally opposite edges among the edges defined by the sloping surfaces 5*x* and the lateral faces that are rotating in the engagement direction, of the upper half portion 51 of the lower fitting 5 is forced against the inner circumferential edge of the engaging hole Fa of the top corner fitting F of the lower container Ct, and thus, the lower fitting 5 receives the reaction force via the pair of sloping surfaces 5*x*, or the pair of diagonally opposite edges that are rotating in the engagement direction, forced against the inner circumferential edge of the engaging hole Fa. Accordingly, as shown in FIG. 11, the upper fitting 4 and the lower fitting 5 of the container coupling device 1 are forcibly rotated around the center of the rotation axis of the shaft 3 against the biasing force of the torsion spring 33 along the inner circumferential edges of the engaging holes Fa of the corner fittings F in the direction in which the upper fitting 4 and the lower fitting 5 overlap the upper fitted portion 22 and the lower fitted portion 33, respectively. Then, when the lower fitting 5 overlaps the lower fitted portion 23 of the device main body 2 as viewed from above, the lower fitting 5, together with the lower fitted portion 23 of the device main body 2, can be released through the engaging hole Fa of the top corner fitting F of the container Ct. At this time, since the upper fitting 4 is in a position at which the upper fitting 4 crosses the engaging hole Fa of the bottom corner fitting F of the lifted container Ct, and is therefore attached to the upper container Ct by engagement with the bottom corner fitting F, the container coupling device 1 can be retained without falling out of the lifted container Ct during transfer from the container ship Sh to the apron Ap.

Next, after the container Ct is lifted and moved via the container crane Cr and stopped at a level of about one meter above the ground of the apron Ap, the upper fitting 4 of the container coupling device 1 is released from the bottom corner fitting F of the container Ct. That is to say, the operation knob 63 is grasped and pulled to lock the locking portion 611 of the wire 61 in the slot 62*a* of the mouthpiece 62. In this state, as described above, the shaft 3 is in the third rotation position C at which the arm 32 abuts against the second locking portion 2*b* of the cavity 2X of the device main body 2, and the upper fitting 4 is overlapping the upper fitted portion 22 of the device main body 2 as viewed from above. Thus, the container coupling device 1 can be released from the engaging hole Fa of the bottom corner fitting F of the container Ct.

As described above, according to the container coupling device 1 of the present invention, since the center of the rotation axis of the shaft 3 coincides with the center of the upper fitting 4 and the lower fitting 5, attachment of the container coupling device 1 to a bottom corner fitting F of a container Ct can be performed irrespective of direction, and as a result, attachment in an incorrect state does no longer occur. Moreover, if an upper container Ct that has been lifted is lowered and placed so that the outer peripheral surface of the upper container Ct is aligned with the outer peripheral surface of a lower container Ct, the lower fitting 5 of the container coupling device 1 can be fitted into the engaging hole Fa of the top corner fitting F of the lower container Ct and engaged with the top corner fitting F. Moreover, in a state in which an upper container Ct and a lower container Ct are coupled together by the container coupling device 1, the lower fitting 5 of the container coupling device 1 can be released from the engaging hole Fa of the top corner fitting F of the lower container Ct by lifting the upper container Ct as it is. Moreover, loading and unloading of containers Ct can be performed without the need for a complicated crane operation that requires considerable skill, and accordingly, the work efficiency can be significantly improved.

Moreover, when lifting an upper container Ct in order to unload containers Ct, the container coupling device 1 can be smoothly rotated without producing a large frictional force because the lower half portion 42 of the upper fitting 4 of the container coupling device 1 that is forced against the inner circumferential edge of the engaging hole Fa of a bottom corner fitting F of the upper container Ct and the upper half portion 51 of the lower fitting 5 that is forced against the inner circumferential edge of the engaging hole Fa of a top corner fitting F of a lower container Ct are formed in such a shape that the upper fitting and the lower fitting are rotated by the reaction force around the center of the rotation axis of the shaft 3 against the biasing force of the torsion spring 33 along the circumferential edges of the engaging holes Fa of the corner fittings F in the direction in which the upper fitting and the lower fitting overlap the upper fitted portion 22 and the lower fitted portion 33, respectively.

Furthermore, since loading and unloading of containers Ct can be performed by lifting up or down a container Ct in the vertical direction, there is no need to leave a certain gap between the container Ct and adjacent containers Ct in the front-and-rear direction and the lateral direction during loading and unloading of the containers Ct, and thus, loading into a limited space such as the hold of a container ship can be performed with an increased load efficiency. Moreover, any desired container Ct can be unloaded, or if there is a space corresponding to the size of a container Ct, the container Ct can be loaded into this space.

It should be noted that in this embodiment, a case in which the upper fitting 4 and the lower fitting 5 are formed in the same shape is described as an example; however, the upper half portion 41 of the upper fitting 4 is inserted into the engaging hole Fa of a bottom corner fitting F of a container Ct by operating the operating member 6, and is therefore not required to be particularly formed in a truncated pyramid shape having sloping surfaces and may have, for example, a rectangular parallelepiped shape.

Moreover, although a case in which the upper fitting 4 is rotated by operating the operating member 6 and is thereby inserted into the engaging hole Fa of a bottom corner fitting F of a container Ct is described as an example, the upper fitting 4 can be inserted into the engaging hole Fa of the bottom corner fitting F of the container Ct by grasping and rotating the lower fitting, and therefore, it is not necessarily required that the operating member 6 be provided.

Furthermore, the shape of the lower half portion 42 of the upper fitting 4 and the shapes of the upper half portion 51 and the lower half portion 52 of the lower fitting 5 can be any shape as long as it can cause the upper fitting and the lower fitting to rotate in the direction in which the upper fitting and the lower fitting overlap the upper fitted portion 22 and the lower fitted portion 23, respectively, when forced against the circumferential edge of the engaging hole Fa of a corner fitting F, and the shapes shown in the drawings in this embodiment are not the limitation. For example, various shapes of lower fittings of conventionally known semi-automatic container coupling devices can be applied.

Second Embodiment

Next, a container coupling device according to a second embodiment of the present invention will be described.

It should be noted that in the following description of the container coupling device 1 according to the second embodiment, the same components as the components of the container coupling device of the above-described first embodiment are denoted by the same reference numerals, omitting their detailed descriptions, and differences from the first embodiment will be described in particular.

Figure 12:
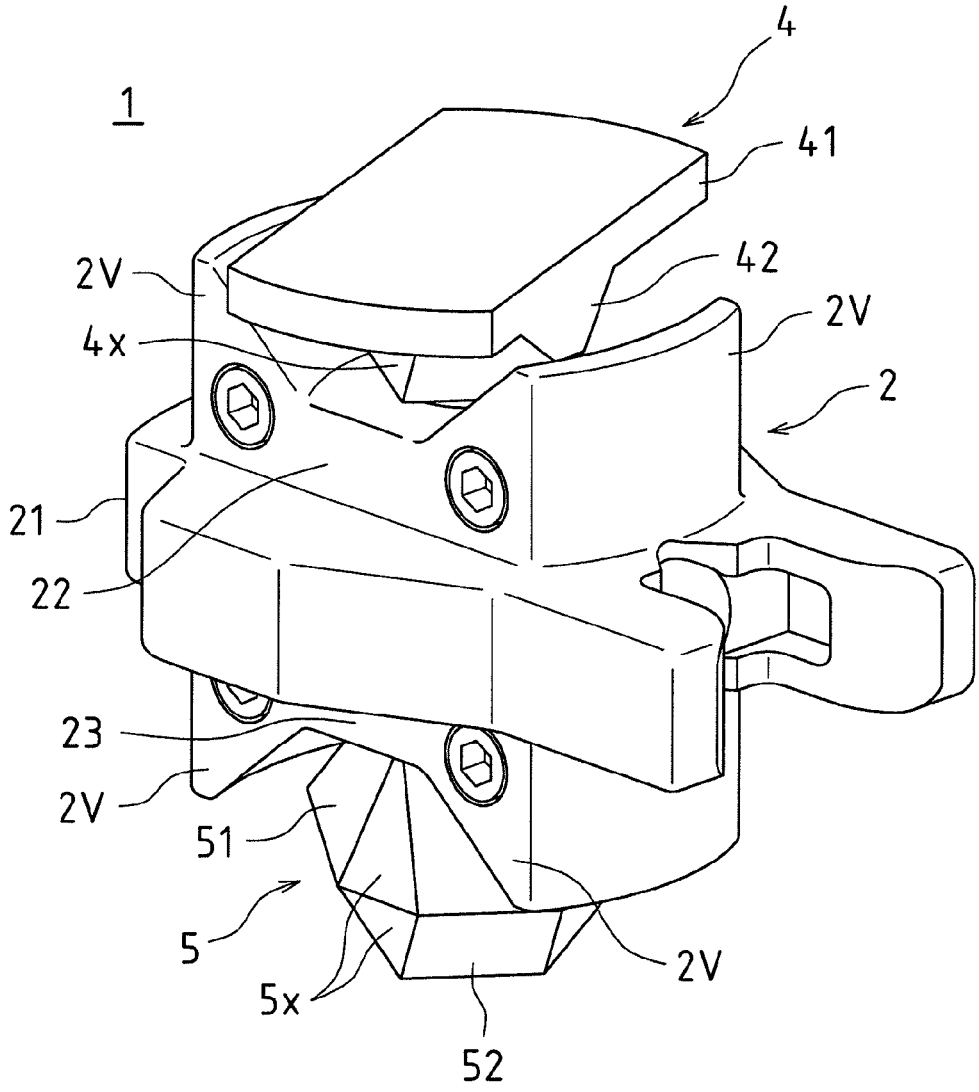
FIG. 12 is a perspective view showing a container coupling device according to a second embodiment of the present invention.
Figure 13:
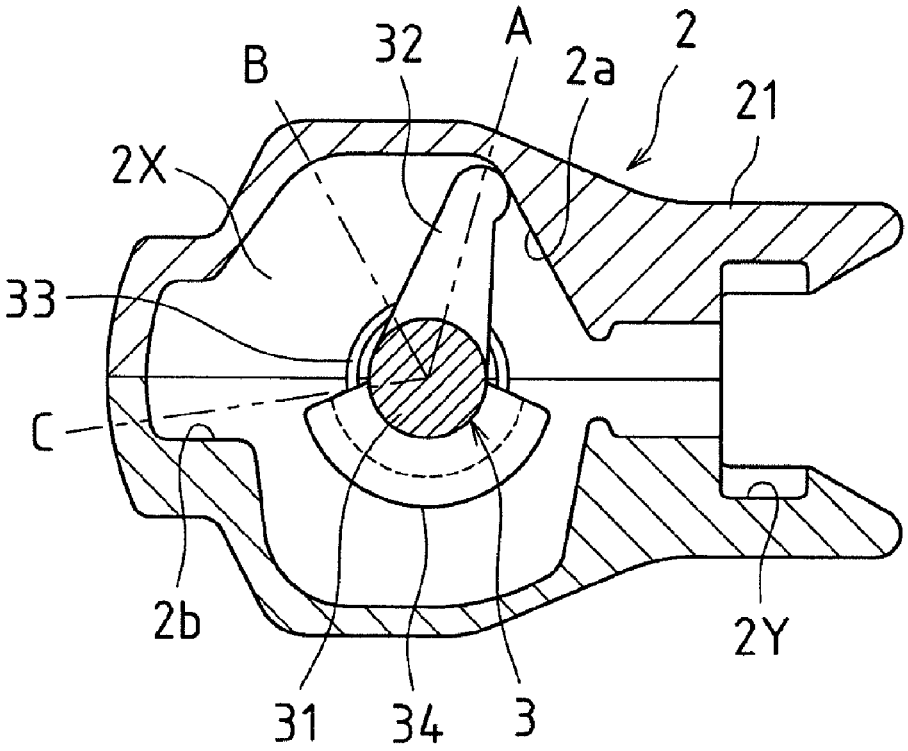
FIG. 13 is a transverse cross-sectional view of the container coupling device in FIG. 12.

In the container coupling device 1 according to this embodiment, as shown in FIGS. 12 and 13, the device main body 2 can be divided into right and left parts, and the right and left parts are fastened to each other into a single unit by a bolt. The shaft 3 is axially supported in this device main body 2 in a rotatable manner, and the upper fitting 4 and the lower fitting 5 are integrally connected to the upper end and the lower end, respectively, of this shaft 3.

The device main body 2 includes the main body portion 21, and the upper fitted portion 22 and the lower fitted portion 23 that are integrally provided in the upper part and the lower part, respectively, of the main body portion 21. These upper fitted portion 22 and lower fitted portion 23 are formed in a shape substantially matching the engaging hole Fa of a corner fitting F of a container Ct as viewed from above, and can be fitted into the engaging hole Fa of a bottom corner fitting F of an upper container Ct and the engaging hole Fa of a top corner fitting F of a lower container Ct, respectively.

Locking portions 2V protruding upward are formed in front and rear edge portions of the upper fitted portion 22 of the device main body 2. These locking portions 2V are formed by an outer surface that is contiguous with the outer peripheral surface of the upper fitted portion 22 and is raised to the vicinity of a junction between the upper half portion 41 and the lower half portion 42 of the upper fitting 4 and an inner surface in the form of a substantially truncated conical surface generated by an edge between adjacent lateral faces of the lower half portion 42 serving as a generatrix so as not to interfere with the lower half portion 42 during rotation of the upper fitting 4 around its center. Locking portions 2V protruding downward also are formed in front and rear edge portions of the lower fitted portion 23 of the device main body 2. These locking portions 2V are formed by an outer surface that is contiguous with the outer peripheral surface of the lower fitted portion 23 and is vertically suspended to the vicinity of a junction between the upper half portion 51 and the lower half portion 52 of the lower fitting 5 and an inner surface in the form of a substantially truncated conical surface generated by an edge between adjacent lateral faces of the upper half portion 51 serving as a generatrix so as not to interfere with the upper half portion 51 during rotation of the lower fitting 5 around its center.

It should be noted that the cavity 2X formed in the device main body 2 allows the arm 32 of the shaft 3 to rotate between the first rotation position A at which the arm 32 abuts against the first locking portion 2*a* of the cavity 2X and the third rotation position C at which the arm 32 abuts against the second locking portion 2*b*.

The upper fitting 4 is formed by the flat plate-like upper half portion 41 that is formed in a shape substantially matching the engaging hole Fa of the corner fitting F of the container Ct as viewed from above and the lower half portion 42 having a truncated pyramid shape that is integrally provided on the bottom surface of the upper half portion 41 in a contiguous manner with its virtual apex being directed downward.

In this lower half portion 42 having the truncated pyramid shape, edges between adjacent lateral faces are chamfered to form the sloping surfaces 4*x* having a substantially triangular shape whose width gradually increases from bottom to top, and in addition the lower half portion 42 of the upper fitting 4 is cut along the outer peripheral surface of the upper half portion 41 so as not to protrude beyond the outer peripheral surface of the upper half portion 41.

Thus, in a state in which the upper fitting 4 and the lower fitting 5 cross the engaging hole Fa of a corner fitting F, if the lower half portion 42 of the upper fitting 4 or the upper half portion 51 or the lower half portion 52 of the lower fitting 5 is brought into contact with and forced against the circumferential edge of the engaging hole Fa of the corner fitting F, the upper fitting 4 or the lower fitting 5 receives the reaction force via a pair of diagonally opposite sloping surfaces 4*x* or 5*x* that are rotating in the engagement direction, or otherwise a pair of diagonally opposite edges among edges defined by the sloping surfaces 4*x* or 5*x* and the lateral faces that are rotating in the engagement direction, and the reaction force acting on the upper fitting 4 or the lower fitting 5 causes the upper fitting 4 and lower fitting 5 to rotate around the center of the rotation axis of the shaft 3 against the biasing force of the torsion spring 33 in the direction in which the upper fitting 4 and the lower fitting 5 overlap the upper fitted portion 22 and the lower fitted portion 23, respectively.

It should be noted that in this embodiment, the operating member 6 is not provided; however, since the device main body 2 and the shaft 3 adopt the same structures as those of the above-described embodiment, the operating member 6 can be attached during assembly of the container coupling device 1, if necessary.

Next, the operation of the container coupling device 1 having the above-described configuration will be described.

In order to attach the container coupling device 1 to a corner fitting F of a container Ct, the lower fitting 5 is grasped and rotated against the biasing force of the torsion spring 33, thereby retaining the shaft 3 in the third rotation position C, that is, the upper fitting 4 in the position at which the upper fitting 4 overlaps the upper fitted portion 22 of the device main body 2 as viewed from above, and the upper fitting 4, together with the upper fitted portion 22 of the device main body 2, is inserted into the engaging hole Fa of a bottom corner fitting F of an upper container Ct.

It should be noted that since the locking portions 2V of the upper fitted portion 22 and the locking portions 2V of the lower fitted portion 23 have an inner surface that does not interfere with rotation of the upper fitting 4 and the lower fitting 5, respectively, and an outer surface that is contiguous with the outer peripheral surface of the upper fitted portion 22, the locking portions 2V do not influence the rotation of the upper fitting 4 and the lower fitting 5, and the upper fitted portion 22 and the lower fitted portion 23 can be fitted into the engaging holes Fa of the corner fittings F irrespective of the locking portions 2V.

Once the upper fitting 4 has been inserted into the engaging hole Fa of the corner fitting F, when the grasp of the lower fitting 5 is cancelled, the shaft 3 returns to the first rotation position A due to the biasing force of the torsion spring 33. In this state, the upper fitting 4 and the lower fitting 5 of the container coupling device 1 are in positions at which the upper fitting 4 and the lower fitting 5 each cross the engaging hole Fa of the corner fitting F, and thus, the container coupling device 1 can be retained without falling out by the upper fitting 4 engaging with the corner fitting F of the container Ct.

Once the container coupling device 1 has been attached to the bottom corner fitting F of the container Ct, the container Ct is lifted by the container crane Cr and placed on top of another container Ct on the deck of the container ship Sh. As a result, the lower fitting 5 of the container coupling device 1 is forced against the outer circumferential edge of the engaging hole Fa of a top corner fitting F of the lower container Ct under the weight of the upper container Ct, and the lower fitting 5 forced against the outer circumferential edge of the engaging hole Fa receives the reaction force, so that the lower fitting 5 is forcibly rotated against the biasing force of the torsion spring 33 in the direction in which the lower fitting 5 overlaps the lower fitted portion 23. Then, when the lower fitting 5 overlaps the lower fitted portion 23 of the device main body 2 as viewed from above, the lower fitting 5, together with the lower fitted portion 23 of the device main body 2, is fitted into the engaging hole Fa of the top corner fitting F of the lower container Ct. Once the lower fitting 5 has been fitted into the top corner fitting F, the lower fitting 5 again returns to the position at which the lower fitting 5 crosses the engaging hole Fa of the corner fitting F due to the biasing force of the torsion spring 33, and thus engages with the corner fitting F. Consequently, the upper and lower containers Ct are coupled together by the upper fitting 4 and the lower fitting 5 of the container coupling device 1 that are engaged with the bottom corner fitting F of the upper container Ct and the top corner fitting F of the lower container Ct, respectively.

On the other hand, in the case of unloading containers Ct from the deck of the container ship Sh, when an upper container Ct is lifted, the inner circumferential edge of the engaging hole Fa of the bottom corner fitting F of the upper container Ct first presses against the lower half portion 42 of the upper fitting 4 of the container coupling device 1, and the container coupling device 1 is raised. The upper half portion 51 of the lower fitting 5 is forced against the inner circumferential edge of the engaging hole Fa of the top corner fitting F of a lower container Ct. As a result, the lower half portion 42 of the upper fitting 4 of the container coupling device 1 is forced against the inner circumferential edge of the engaging hole Fa of the bottom corner fitting F of the upper container Ct. The upper fitting 4 forced against the inner circumferential edge of the engaging hole Fa receives the reaction force. Similarly, the upper half portion 51 of the lower fitting 5 is forced against the engaging hole Fa of the top corner fitting F of the lower container Ct, and thus the lower fitting 5 receives the reaction force.

Figure 14:
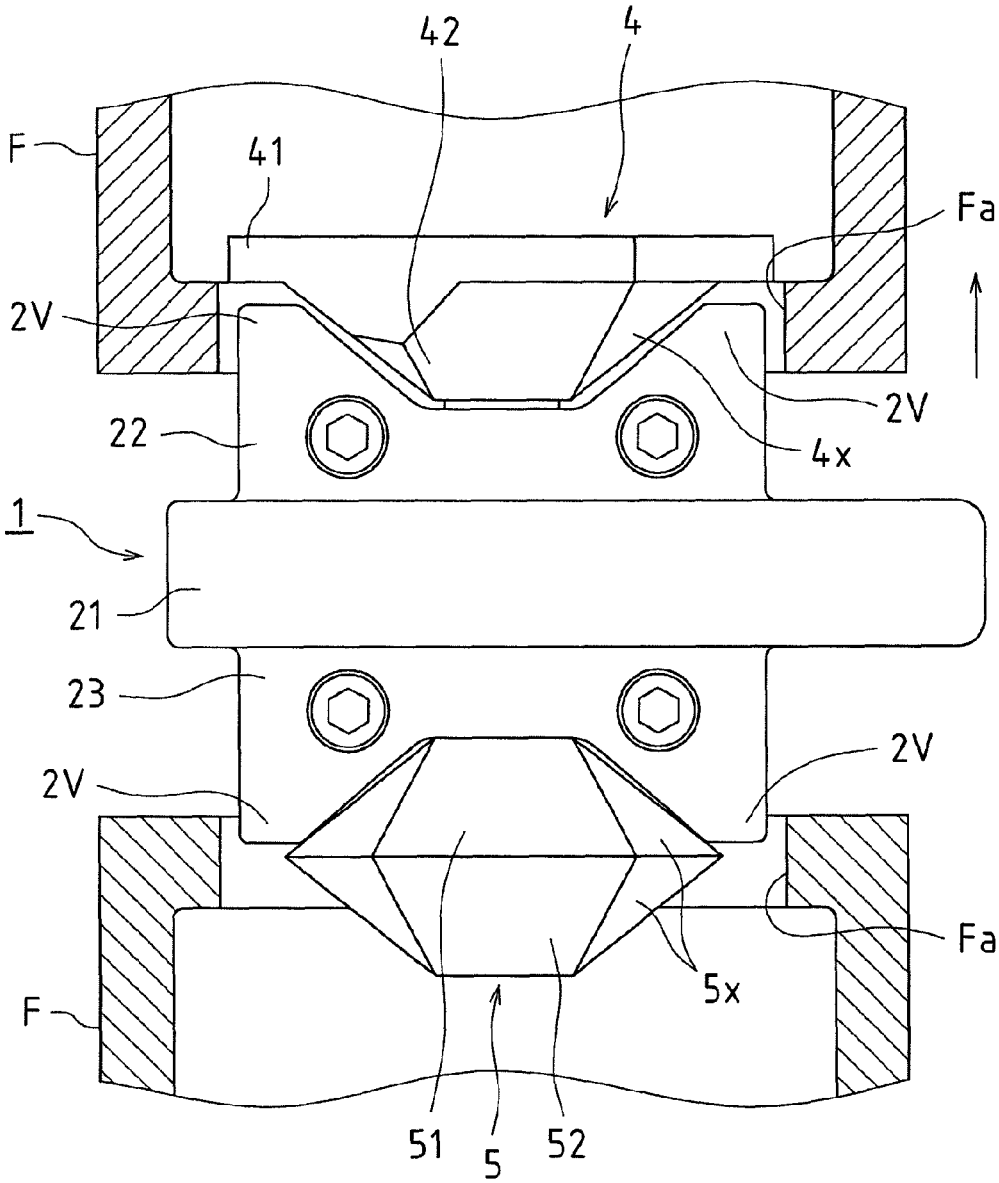
FIG. 14 is an explanatory diagram showing a state of the container coupling device in FIG. 12 during uncoupling of an upper container and a lower container coupled together by the container coupling device.
Figure 15:
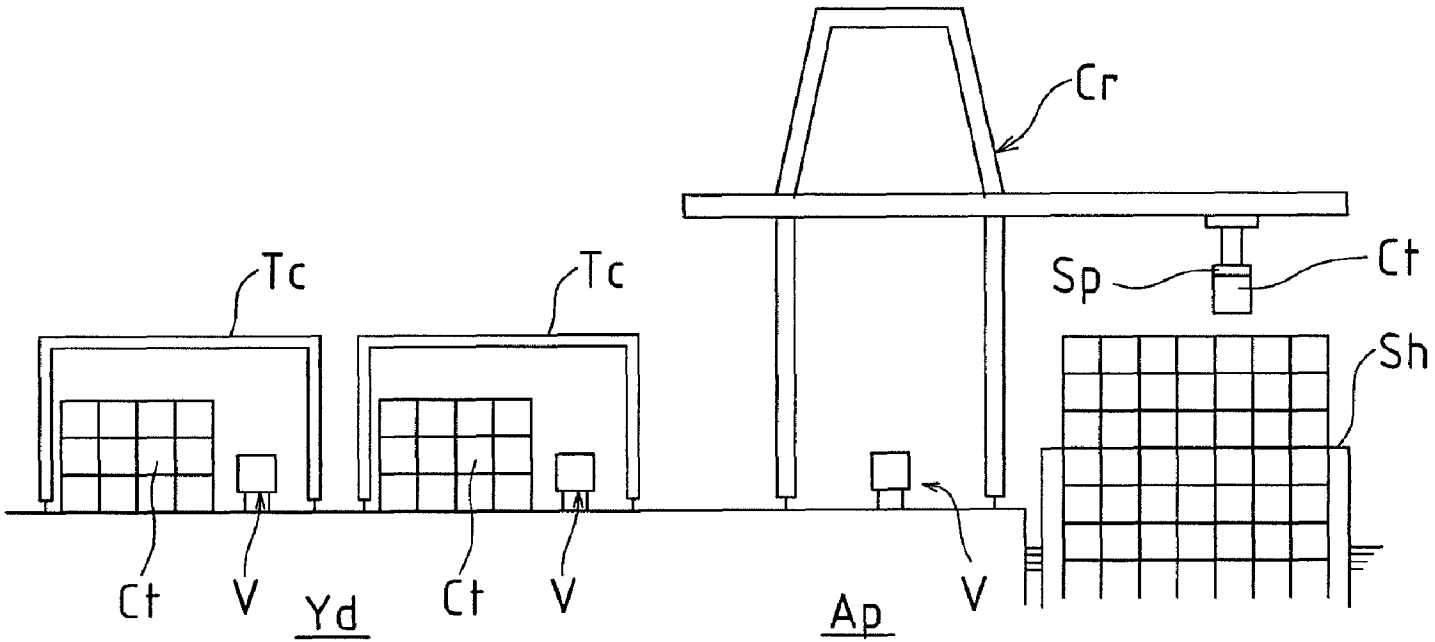
FIG. 15 is an explanatory diagram schematically showing how a container is transported by a container conveying vehicle between a container yard and an apron and a container is loaded and unloaded by a container crane between the container conveying vehicle and a container ship.
Figure 16:
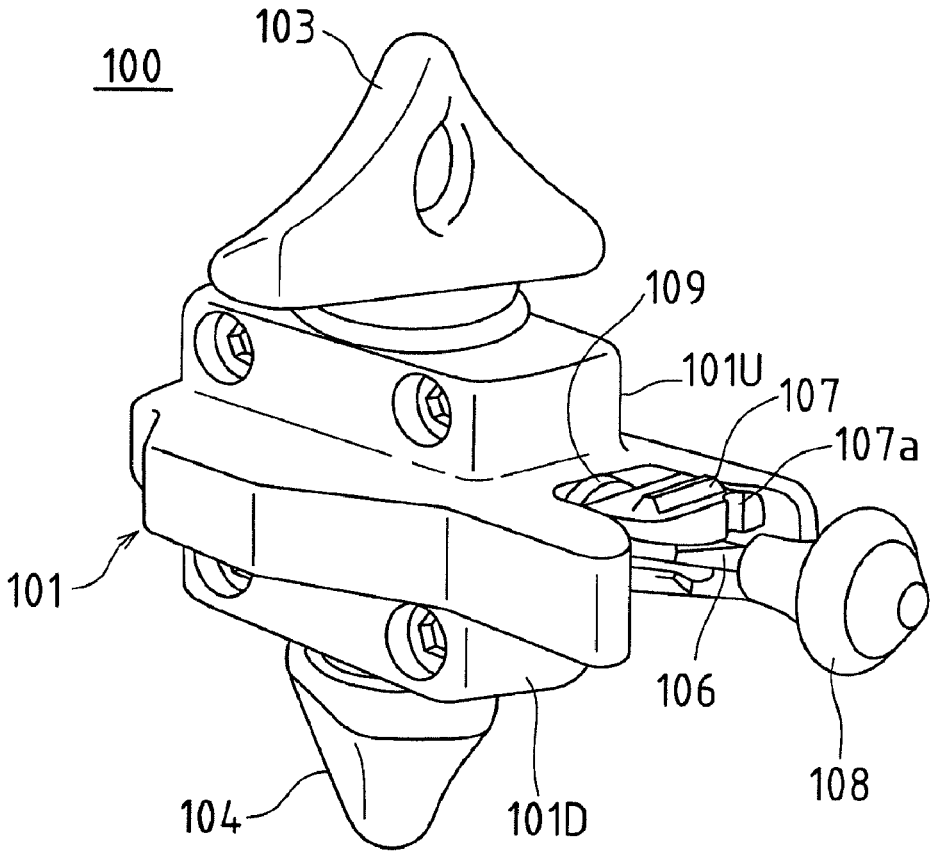
FIG. 16 is a perspective view of a conventional container coupling device.
Figure 17:
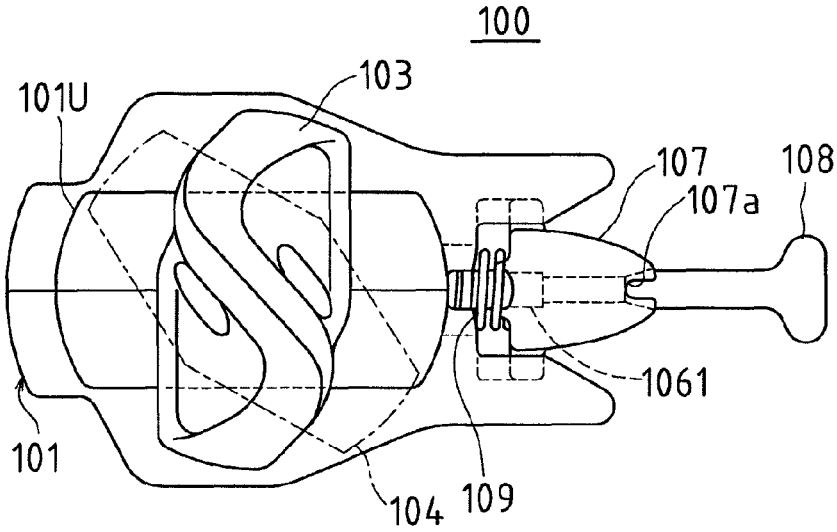
FIG. 17 is a plan view of the container coupling device in FIG. 16.
Figure 18:
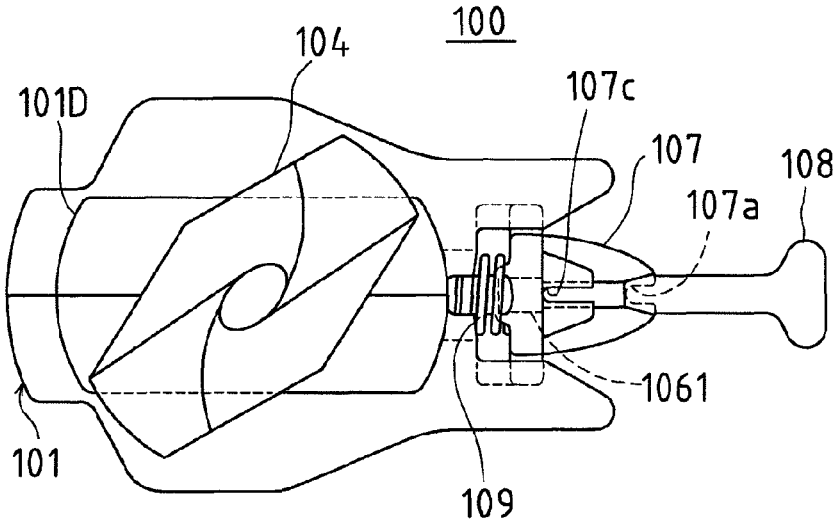
FIG. 18 is a bottom view of the container coupling device in FIG. 16.
Figure 19:
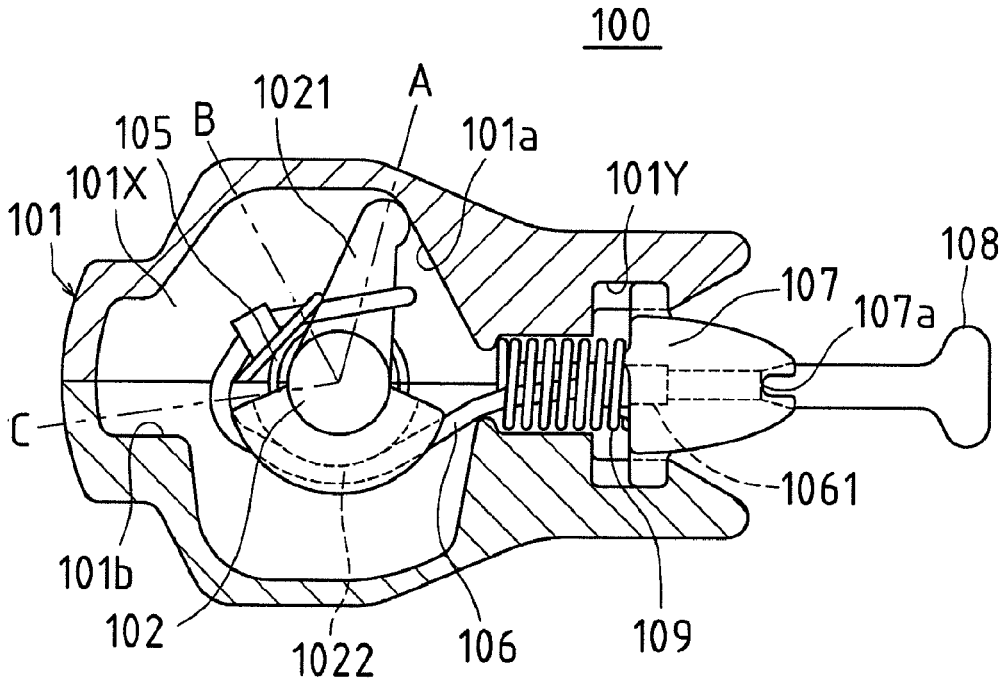
FIG. 19 is a transverse cross-sectional view of the container coupling device in FIG. 16.

Therefore, the upper fitting 4 and the lower fitting 5 of the container coupling device 1 are forcibly rotated against the biasing force of the torsion spring 33 along the inner circumferential edges of the engaging holes Fa of the corner fittings F in the direction in which the upper fitting 4 and the lower fitting 5 overlap the upper fitted portion 22 and the lower fitted portion 33, respectively. Then, when the lower fitting 5 overlaps the lower fitted portion 23 of the device main body 2 as viewed from above, the lower fitting 5, together with the lower fitted portion 23 of the device main body 2, can be released through the engaging hole Fa of the top corner fitting F of the container Ct. At this time, the upper fitting 4, which is in a position at which the upper fitting 4 crosses the engaging hole Fa of the bottom corner fitting F of the lifted container Ct, is engaged with the bottom corner fitting F and hence attached to the upper container Ct. Moreover, the locking portions 2V of the upper fitted portion 22 are locked by the inner circumferential surface of the engaging hole Fa of the bottom corner fitting F of the lifted container Ct (see FIG. 14) and retained without rotating with respect to the bottom corner fitting F of the container Ct. Thus, the container coupling device 1 is reliably attached to the bottom corner fitting F of the lifted container Ct and can be retained without falling out of the container Ct during transfer from the container ship Sh to the apron Ap.

Next, after the container Ct is lifted and moved via the container crane Cr and stopped at a level of about one meter from the ground of the apron Ap, the upper fitting 4 is rotated via the lower fitting 5 to the position at which the upper fitting 4 overlaps the upper fitted portion 22 of the device main body 2 as viewed from above, and the upper fitting 4 of the container coupling device 1 can be released from the bottom corner fitting F of the container Ct.

As described above, according to the container coupling device 1 of this embodiment, since the center of the rotation axis of the shaft 3 coincides with the center of the upper fitting 4 and the lower fitting 5, attachment of the container coupling device 1 to a bottom corner fitting F of a container Ct can be performed irrespective of direction, and thus, incorrect attachment does no longer occur. Moreover, if an upper container Ct that has been lifted is lowered and placed in such a manner that the outer peripheral surface of the upper container Ct is aligned with the outer peripheral surface of a lower container Ct, the lower fitting 5 of the container coupling device 1 can be fitted into the engaging hole Fa of the top corner fitting F of the lower container Ct and engaged with the top corner fitting F, and in a state in which the upper container Ct and the lower container Ct are coupled together by the container coupling device 1, the lower fitting 5 of the container coupling device 1 can be released from the engaging hole Fa of the top corner fitting F of the lower container Ct by lifting the upper container Ct as it is, so that loading and unloading of containers Ct can be performed without the need for a complicated crane operation that requires considerable skill, and accordingly, the work efficiency can be significantly improved.

Moreover, when lifting an upper container Ct in order to unload containers Ct, the container coupling device 1 can be smoothly rotated without producing a large frictional force because the lower half portion 42 of the upper fitting 4 of the container coupling device 1 that is forced against the inner circumferential edge of the engaging hole Fa of a bottom corner fitting F of the upper container Ct and the upper half portion 51 of the lower fitting 5 that is forced against the inner circumferential edge of the engaging hole Fa of a top corner fitting F of a lower container Ct are formed in such a shape that the upper fitting and the lower fitting are rotated by the reaction force around the center of the rotation axis of the shaft 3 against the biasing force of the torsion spring 33 along the circumferential edges of the engaging holes Fa of the corner fittings F in the direction in which the upper fitting and the lower fitting overlap the upper fitted portion 22 and the lower fitted portion 33, respectively. At this time, the upper fitting 4 is in a position at which the upper fitting 4 crosses the engaging hole Fa of the bottom corner fitting F of the lifted container Ct and the locking portions 2V of the upper fitted portion 22 are locked by the inner circumferential surface of the engaging hole Fa of the bottom fitting F of the container Ct, and thus, the container coupling device 1 is prevented from accidentally rotating with respect to the bottom corner fitting F of the container Ct and reliably attached to the bottom corner fitting F of the container Ct, and therefore can be retained without falling out of the container Ct.

Furthermore, since loading and unloading of containers Ct can be performed by lifting up or down a container Ct in the vertical direction, there is no need to leave a certain gap between the container Ct and adjacent containers Ct in the front-and-rear direction and the lateral direction during loading and unloading of the containers Ct, and thus, loading into a limited space such as the hold of a container ship can be performed with an increased load efficiency. Moreover, any desired container Ct can be unloaded, or if there is a space corresponding to the size of a container Ct, the container Ct can be loaded into this space.

In the above-described embodiment, a case in which the locking portions 2V are formed in each of the upper fitted portion 22 and the lower fitted portion 23 is described. However, the locking portions 2V may be formed in only the upper fitted portion 22.

Moreover, although locking portions formed by an outer surface that is contiguous with the outer peripheral surface of the upper fitted portion 22 (the lower fitted portion 23) and that is raised to the vicinity of the junction between the upper half portion 41 and the lower half portion 42 of the upper fitting 4 (an outer surface that is raised to the vicinity of the junction between the upper half portion 51 and the lower half portion 52 of the lower fitting 5) and an inner surface in the form of a substantially truncated conical surface generated by an edge between adjacent lateral faces of the lower half portion 42 (the upper half portion 51) serving as a generatrix so as not to interfere with the lower half portion 42 during rotation of the upper fitting 4 around its center (so as not to interfere with the upper half portion 51 during rotation of the lower fitting 5 around its center) are described as an example of the locking portions 2V, the locking portions 2V are not limited to this shape as long as the locking portions 2V can be locked by the inner circumferential surface of the engaging hole of a container when the container is lifted and can regulate accidental rotation of the container coupling device with respect to the corner fitting. For example, the locking portions 2V may also be pin-like portions, peripheral wall-like portions, or the like protruding from the top surface of the upper fitted portion 22 (the bottom surface of the lower fitted portion 23).

The present invention may be embodied in various other forms without departing from the spirit or essential characteristics thereof. Accordingly, the above-described embodiments are to be considered in all respects as illustrative and not limiting. The scope of the invention is indicated by the appended claims rather than by the foregoing description. Furthermore, all variations and modifications falling within the meaning and range of equivalency of the appended claims are intended to be embraced within the scope of the invention.

It should be noted that this application claims priority on Patent Application No. 2008-106885 filed in Japan on Apr. 16, 2008, the entire contents of which are herein incorporated by reference. Moreover, all documents cited in this specification are herein incorporated by reference.

The invention claimed is:

1. A container coupling device comprising:

a device main body having an upper fitted portion and a lower fitted portion that can be fitted into an engaging hole of a corner fitting of a container;

a shaft that is rotatably supported in the device main body;

an upper fitting and a lower fitting that are integrally connected to an upper end and a lower end, respectively, of the shaft so as to cross in an X shape as viewed from above and be concentric with an axis of the shaft and that are engageable with the corner fitting through the engaging hole thereof; and a spring means that is provided between the shaft and the device main body and that biases the upper fitting and the lower fitting so as to rotate the upper fitting and the lower fitting to a position at which the upper fitting and the lower fitting engage with the corner fitting, wherein a lower half portion of the upper fitting and an upper half portion of the lower fitting are formed in such a shape that when the lower half portion or the upper half portion is pressed via the engaging hole of the corner fitting, a rotational force is applied in a direction in which the upper fitting and the lower fitting overlap the upper fitted portion and the lower fitted portion, respectively, when an upper container is lifted with the upper fitting and the lower fitting being engaged with a corner fitting of the upper container and a corner fitting of a lower container, respectively, via the spring means, a container weight acts on the lower half portion of the upper fitting via an engaging hole of the corner fitting of the upper container and on the upper half portion of the lower fitting via an engaging hole of the corner fitting of the lower container, and the upper fitting and the lower fitting rotate against a biasing force of the spring means in the direction in which the upper fitting and the lower fitting overlap the upper fitted portion and the lower fitted portion, respectively, and the lower fitting rotates to a position at which the lower fitting overlaps the lower fitted portion while the upper fitting is engaged with the corner fitting of the upper container.

2. A container coupling device comprising:

a device main body having an upper fitted portion and a lower fitted portion that can be fitted into an engaging hole of a corner fitting of a container;

a shaft that is rotatably supported in the device main body;

an upper fitting and a lower fitting that are integrally connected to an upper end and a lower end, respectively, of the shaft so as to cross in an X shape as viewed from above and be concentric with an axis of the shaft and that are engageable with the corner fitting via the engaging hole thereof; and a spring means that is provided between the shaft and the device main body and that biases the upper fitting and the lower fitting so as to rotate the upper fitting and the lower fitting to a position at which the upper fitting and the lower fitting engage with the corner fitting, wherein a lower half portion of the upper fitting and an upper half portion of the lower fitting are formed in such a shape that when the lower half portion or the upper half portion is pressed via the engaging hole of the corner fitting, a rotational force is applied in a direction in which the upper fitting and the lower fitting overlap the upper fitted portion and the lower fitted portion, respectively, a locking portion that can be locked by an inner circumferential surface of the engaging hole of the corner fitting is formed at least on a top surface of the upper fitted portion in such a manner that the locking portion does not interfere with rotation of the upper fitting, when an upper container is lifted with the upper fitting and the lower fitting being engaged with a corner fitting of the upper container and a corner fitting of a lower container, respectively, via the spring means, the locking portion of the upper fitted portion is locked by the inner circumferential surface of an engaging hole of the corner fitting of the upper container, and a container weight acts on the lower half portion of the upper fitting via the engaging hole of the corner fitting of the upper container and on the upper half portion of the lower fitting via an engaging hole of the corner fitting of the lower container, and the upper fitting and the lower fitting rotate against a biasing force of the spring means in the direction in which the upper fitting and the lower fitting overlap the upper fitted portion and the lower fitted portion, respectively, and the lower fitting rotates to a position at which the lower fitting overlaps the lower fitted portion while the upper fitting is engaged with the corner fitting of the upper container.

3. The container coupling device according to claim 1, further comprising an operating member for rotating the shaft.

4. The container coupling device according to claim 1, further comprising a flag that enables visual observation of a rotation position of the shaft.

5. A container coupling device comprising:

a device main body having an upper fitted portion and a lower fitted portion that can be fitted into an engaging hole of a corner fitting of a container;

a shaft that is rotatably supported in the device main body;

an upper fitting and a lower fitting that are integrally connected to an upper end and a lower end, respectively, of the shaft so as to cross in an X shape as viewed from above and be concentric with an axis of the shaft and that are engageable with the corner fitting through the engaging hole thereof; and a spring means that is provided between the shaft and the device main body and that biases the upper fitting and the lower fitting so as to rotate the upper fitting and the lower fitting to a position at which the upper fitting and the lower fitting engage with the corner fitting, wherein a lower half portion of the upper fitting and an upper half portion of the lower fitting each have a sloping surface having a shape that, when the sloping surface is pressed via the engaging hole of the corner fitting, generates a rotational force in a direction in which the lower fitting and the upper fitting overlap the upper fitted portion and the lower fitted portion, respectively, when an upper container is lifted with the upper fitting and the lower fitting being engaged with a corner fitting of the upper container and a corner fitting of a lower container, respectively, via the spring means, a container weight acts on the lower half portion of the upper fitting via an engaging hole of the corner fitting of the upper container and on the upper half portion of the lower fitting via an engaging hole of the corner fitting of the lower container, the upper fitting and the lower fitting rotate against a biasing force of the spring means in the direction in which the upper fitting and the lower fitting overlap the upper fitted portion and the lower fitted portion, respectively, and the lower fitting rotates to a position at which the lower fitting overlaps the lower fitted portion while the upper fitting is engaged with the corner fitting of the upper container, and the lower fitting is released from the engaging hole of the corner fitting of the lower container simply by lifting the upper container without the need to perform any operation on the device main body.

6. A container coupling device comprising:

a device main body having an upper fitted portion and a lower fitted portion that can be fitted into an engaging hole of a corner fitting of a container;

a shaft that is rotatably supported in the device main body;

an upper fitting and a lower fitting that are integrally connected to an upper end and a lower end, respectively, of the shaft so at to cross in an X shape as viewed from above and be concentric with an axis of the shaft and that are engageable with the corner fitting through the engaging hole thereof; and a spring means that is provided between the shaft and the device main body and that biases the upper fitting and the lower fitting so as to rotate the upper fitting and the lower fitting to a position at which the upper fitting and the lower fitting engage with the corner fitting, wherein a lower half portion of the upper fitting and an upper half portion of the lower fitting each have a sloping surface having a shape that, when the sloping surface is pressed via the engaging hole of the corner fitting, generates a rotational force in a direction in which the upper fitting and the lower fitting overlap the upper fitted portion and the lower fitted portion, respectively, a locking portion that can be locked by an inner circumferential surface of the engaging hole of the corner fitting is formed at least on a top surface of the upper fitted portion in such a manner that the locking portion does not interfere with rotation of the upper fitting, when an upper container is lifted with the upper fitting and the lower fitting being engaged with corner fittings of the upper container and corner fittings of a lower container, respectively, via the spring means, the locking portion of the upper fitted portion is locked by an inner circumferential surface of an engaging hole of a respective said corner fitting of the upper container, and a container weight acts on the lower half portion of the upper fitting via the engaging hole of the corner fitting of the upper container and on the upper half portion of the lower fitting via an engaging hole of the respective corner fitting of the lower container, the upper fitting and the lower fitting rotate against the biasing force of the spring means in the direction in which the upper fitting and the lower fitting overlap the upper fitted portion and the lower fitted portion, respectively, and the lower fitting rotates to a position at which the lower fitting overlaps the lower fitted portion while the upper fitting is engaged with a respective said corner fitting of the upper container, and the lower fitting is released from the respective engaging hole of the corner fitting of the lower container simply by lifting the upper container without the need to perform any operation on the device main body.

7. The container coupling device according to claim 5, wherein the sloping surface provided in the lower half portion of the upper fitting and the upper half portion of the lower fitting is formed as a pair of diagonally opposite sloping surfaces.

8. The container coupling device according to claim 6, wherein the sloping surface provided in the lower half portion of the upper fitting and the upper half portion of the lower fitting is formed as a pair of diagonally opposite sloping surfaces.

9. The container coupling device according to claim 2, further comprising an operating member for rotating the shaft.

10. The container coupling device according to claim 2, further comprising a flag that enables visual observation of a rotation position of the shaft.

* * * * *